US007645547B2

(12) United States Patent
Okuda et al.

(10) Patent No.: US 7,645,547 B2
(45) Date of Patent: Jan. 12, 2010

(54) ELECTROPHOTOGRAPHIC PHOTOSENSITIVE MEMBER, PROCESS CARTRIDGE AND ELECTROPHOTOGRAPHIC APPARATUS

(75) Inventors: Atsushi Okuda, Yokohama (JP); Harunobu Ogaki, Suntou-gun (JP); Wataru Kitamura, Numazu (JP); Hirotoshi Uesugi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/211,674

(22) Filed: Sep. 16, 2008

(65) Prior Publication Data

US 2009/0029277 A1 Jan. 29, 2009

Related U.S. Application Data

(63) Continuation of application No. PCT/JP2008/056638, filed on Mar. 27, 2008.

(30) Foreign Application Priority Data

Mar. 28, 2007 (JP) ..... 2007-085141

(51) Int. Cl.
*G03G 15/00* (2006.01)

(52) U.S. Cl. ..... 430/56; 430/66; 430/96; 399/159

(58) Field of Classification Search ..... 430/56, 430/66, 96; 399/159
See application file for complete search history.

(56) References Cited

U.S. PATENT DOCUMENTS

| | | | | |
|---|---|---|---|---|
| 5,114,814 | A | 5/1992 | Sakoh et al. | 430/46 |
| 6,699,631 | B2 | 3/2004 | Miyamoto et al. | 430/56 |
| 6,942,952 | B2 | 9/2005 | Uesugi et al. | 430/66 |
| 7,186,489 | B2 | 3/2007 | Uematsu et al. | 430/66 |
| 7,226,711 | B2 | 6/2007 | Amamiya et al. | 430/58.7 |
| 7,402,366 | B2 | 7/2008 | Hayata et al. | 430/66 |
| 7,556,901 | B2 * | 7/2009 | Anezaki et al. | 430/56 |
| 2002/0160287 | A1 | 10/2002 | Miyamoto et al. | 430/56 |
| 2003/0059695 | A1 | 3/2003 | Li et al. | 430/66 |
| 2005/0255393 | A1 | 11/2005 | Nakata et al. | 430/56 |

(Continued)

FOREIGN PATENT DOCUMENTS

JP 52-026226 2/1977

(Continued)

OTHER PUBLICATIONS

Abstract of JP 7-261442, published Oct. 13, 1995.

(Continued)

*Primary Examiner*—Mark A Chapman
(74) *Attorney, Agent, or Firm*—Fitzpatrick, Cella, Harper & Scinto

(57) ABSTRACT

An electrophotographic photosensitive member is provided which has a photosensitive layer formed on a support. The electrophotographic photosensitive member has a surface layer containing a silicon-containing compound or a fluorine-containing compound. The surface layer has a plurality of depressed portions which are independent from one another, on the surface. When the major axis diameter of the depressed portion is represented by Rpc and the distance between the deepest part and the opening surface of the depressed portion is represented by Rdv, Rdv is 0.1μ or more to 10.0 μm or less, and the ratio of the depth (Rdv) to the major axis diameter (Rpc), Rdv/Rpc, is more than 0.3 to 7.0 or less.

19 Claims, 10 Drawing Sheets

U.S. PATENT DOCUMENTS

| | | | | |
|---|---|---|---|---|
| 2008/0019735 | A1 | 1/2008 | Ogaki et al. | 399/159 |
| 2008/0124637 | A1 | 5/2008 | Uematsu et al. | 430/56 |

FOREIGN PATENT DOCUMENTS

| | | |
|---|---|---|
| JP | 57-094772 | 6/1982 |
| JP | 01-099060 | 4/1989 |
| JP | 02-272557 | 11/1990 |
| JP | 05-072753 | 3/1993 |
| JP | 05-265243 | 10/1993 |
| JP | 07-013368 | 1/1995 |
| JP | 07-261440 | 10/1995 |
| JP | 11-258843 | 9/1999 |
| JP | 2001-042557 | 2/2001 |
| JP | 2001-066814 | 3/2001 |
| JP | 2002-341572 | 11/2002 |
| JP | 2003-202686 | 7/2003 |
| JP | 2004-117849 | 4/2004 |
| JP | 2005-338586 | 12/2005 |
| JP | 2007-004134 | 1/2007 |
| JP | 2007-065305 | 3/2007 |
| WO | WO 2005/093518 A1 | 10/2005 |

OTHER PUBLICATIONS

Abstract of JP 61-095358, published May 14, 1986.

* cited by examiner

ELECTROPHOTOGRAPHIC PHOTOSENSITIVE MEMBER, PROCESS CARTRIDGE AND ELECTROPHOTOGRAPHIC APPARATUS

This application is a continuation of International Application No. PCT/JP2008/056638, filed Mar. 27, 2008, which claims the benefit of Japanese Patent Application No. 2007-085141, filed Mar. 28, 2007.

BACKGROUND OF THE INVENTION

Field of the Invention

The present invention relates to an electrophotographic photosensitive member and a process cartridge and electrophotographic apparatus having the electrophotographic photosensitive member.

An electrophotographic photosensitive member (hereinafter sometimes simply referred to as a "photosensitive member" or a "photosensitive drum") is generally used in an electrophotographic image forming process, which is constituted of a charging step, an exposure step, a developing step, a transfer step and a cleaning step. Of the electrophotographic image forming process, the cleaning step for cleaning the circumference surface of an electrographic photosensitive member by removing toner called transfer-residual toner remaining on the electrographic photosensitive member after the transfer step, is an important step for obtaining clear images. In a cleaning method using a cleaning blade, cleaning is performed by rubbing an electrophotographic photosensitive member with a cleaning blade. Depending upon the friction force generated between the cleaning blade and the electrophotographic photosensitive member, phenomena such as cleaning-blade chattering and cleaning-blade turn-up may occur. The blade chattering herein is a phenomenon where a cleaning blade vibrates by large frictional resistance between the cleaning blade and the circumference surface of an electrophotographic photosensitive member. On the other hand, the cleaning-blade turn-up is a phenomenon where a cleaning blade reversely turns against the moving direction of an electrophotographic photosensitive member.

These problems of a cleaning blade and an electrophotographic photosensitive member are seemed to be more significant as the abrasion resistance of the surface layer of the electrophotographic photosensitive member increases, in other words, as the circumference surface of the electrophotographic photosensitive member becomes more resistant to abrasion. The surface layer of an organic electrophotographic photosensitive member, which is generally and frequently formed by a dip coating method, in other words, the circumference surface of the electrophotographic photosensitive member tends to be formed flat and smooth. Thus, the contact area at which a cleaning blade and the circumference surface of an electrophotographic photosensitive member are in contact with each other increases, raising friction resistance between them. As a result, the aforementioned problems likely become more significant.

Recently, to improve images in quality, the size of toner particles has been made smaller and smaller. As the size of toner particles reduces, the contact area, at which toner particles are in contact with a photosensitive drum, increases. Because of this, the adhesive force of toner to the surface of the photosensitive drum per unit mass increases. As a result, the cleaning properties of the photosensitive drum surface decrease. To prevent and suppress toner from slipping through a cleaning blade, it is necessary to increase the contact pressure of a cleaning blade. However, the surface of the photosensitive drum is formed very uniformly as described above and exhibits high adhesiveness to the cleaning blade. For the structural reason, troubles such as blade chattering and blade turn-up more easily occur. In particular, since a friction coefficient increases in high-humidity environment, these troubles more remarkably occur.

As one of the approaches for overcoming these problems (cleaning-blade chattering and cleaning-blade turn-up) involved in a cleaning blade and an electrophotographic photosensitive member, a method of appropriately roughening the surface of the electrophotographic photosensitive member has been proposed.

Examples of the method of roughening the surface of the electrophotographic photosensitive member are as follows. Japanese Patent Application Laid-Open No. S52-026226 (Patent Document 1) discloses a technique for roughening the surface of an electrophotographic photosensitive member by adding particles in the surface layer. Japanese Patent Application Laid-Open No. S57-094772 (Patent Document 2) discloses a technique for roughening the surface of an electrophotographic photosensitive member by polishing the surface of the surface layer with a wire brush made of metal. Japanese Patent Application Laid-Open No. H01-99060 (Patent Document 3) discloses a technique for roughening the surface of an organic electrophotographic photosensitive member by use of a specific cleaning means and toner. Japanese Patent Application Laid-Open No. 2001-066814 (Patent Document 5) discloses a technique for roughening the surface of an electrophotographic photosensitive member by polishing the surface of the surface layer by use of a film-shaped polishing material. WO2005/93518 pamphlet (Patent Document 4) discloses a technique for roughening the circumference surface of an electrophotographic photosensitive member by blast treatment. The pamphlet discloses an electrophotographic photosensitive member having dimples of predetermined form, thereby remedying troubles likely to occur under high temperature/humidity environment, such as image deletion and toner transfer. Japanese Patent Application Laid-Open No. 2001-066814 (Patent Document 5) further discloses a technique for processing the surface of an electrophotographic photosensitive member by compression molding using a stamper having well-shaped projections and depressions.

On the other hand, there is another approach proposed for overcoming the problems (cleaning-blade chattering and cleaning-blade turn-up) involved in a cleaning blade and an electrophotographic photosensitive member. This is a method of imparting lubricity to the surface of an electrophotographic photosensitive member. Methods of imparting lubricity to the surface of an electrophotographic photosensitive member are roughly divided into two groups. One is a group of methods, which applies a lubricant to the surface of a photosensitive member from the outside. The other is a group of methods of incorporating a lubricant into the surface layer.

Japanese Patent Application Laid-Open No. 2002-341572 (Patent Document 6) discloses a means for applying a lubricant to the surface of a photosensitive member with the lubricant being a metal soap such as zinc stearate. On the other hand, Japanese Patent Application Laid-Open No. H07-013368 (Patent Document 7) proposes adding silicone oil and Japanese Patent Application Laid-Open No. H11-258843 (Patent Document 8) proposes adding fluorine oil to improve lubricity of the surface of a photosensitive member. Japanese Patent Application Laid-Open No. H05-072753 (Patent Document 9) proposes a method of using a polycarbonate resin, which is obtained by copolymerization of a siloxane chain with a main chain of polycarbonate, as a binder of a surface layer.

SUMMARY OF THE INVENTION

However, the method of dispersing fine particles in the surface layer of an electrophotographic photosensitive member described in Patent Document 1 has problems below: the surface of the photosensitive member is scratched by the dispersion: a large amount of fine particles must be added in order for dispersed fine particles to produce long-lasting effect upon cleaning performance; and a dispersion agent or an auxiliary dispersion agent may degrade characteristics of an electrophotographic photosensitive member, such as potential characteristic, during long-term repeated use.

Furthermore, in the surface of an electrophotographic photosensitive member described in each of Patent Documents 2 to 6, when an about several-μm area of the surface-processed region in the surface which is roughened is observed, the micro region is found to be not uniform. The micro region may not be said to be sufficiently roughened (for forming projections and depressions on the surface) enough to improve cleaning-blade chattering and cleaning-blade turn-up. For the reasons so far mentioned, problems such as of cleaning-blade chattering and cleaning-blade turn-up have not yet been sufficiently overcome and further improvement is desired.

Additionally, in a method of roughening the surface of an electrophotographic photosensitive member by a film-shaped polishing sheet or blast, even though a fluorine- or silicon-containing compound is present in the surface, the fluorine- or silicon-containing compound distributed in the surface is ripped off or the compound fails to uniformly distribute by an inherent feature of the compound, that is, migration toward a front surface. As a result, the method is not sufficient to produce persistently-high effects upon cleaning performance for a long period of time.

Conversely, in the case where lubricity is imparted to the surface of a photosensitive member by applying a fluorine- or silicon-containing compound serving as a lubricant instead of roughening the surface, since the properties of the fluorine- or silicon-containing compound can be exhibited in the beginning, a high degree of smoothness can be obtained and cleaning-blade chattering and cleaning-blade turn-up can be suppressed. As a result, good cleaning performance may be often obtained. However, when the surface layer is abraded during long-term repeated use and accordingly a large amount of fluorine- or silicon-containing compound present is removed from the proximity of the surface, a sufficient effect cannot be obtained. For this reason, the use of such a compound may not be sufficient to persistently obtain persistently high effects during long-term repeated use. To prevent blade chattering and blade turn-up on the part of an electrophotographic photosensitive member, a large amount of fluorine- or silicon-containing compound must be added to the member. In this case, mechanical strength of the photosensitive member tends to decrease, so that the photosensitive member has insufficient durability. On the other hand, when silicone oil such as dimethylsilicone oil is added in an amount sufficient to obtain desired lubricity, residual potential tends to significantly increase and the coating constituting a charge transport layer tends to turn white and turbid. Also from the aspect of the optical characteristics of the coating, troubles may arise: image quality deteriorates; and images with a lower density due to the decrease in sensitivity and memory images are formed.

These problems are likely to occur significantly when a large number of paper sheets are printed with a low printing density and when monochrome printing is continuously made in a tandem electrophotographic system. Under these conditions, the amount of developer components such as a toner or external additive present in a cleaning blade becomes extremely small. Thus, toner must be periodically supplied from a developer container during a rotation operation after printing or intervals between continuous printing operations. However, from the aspect of decreased printing speed and operating life of the developer, preferably, periodical supply of toner from a developer container should not be performed.

In view of the aforementioned circumstances, an object of the present invention is to provide an electrophotographic photosensitive member, which maintains excellent smoothness of the surface thereof and exhibits improved cleaning performance during long-term repeated use, and which suppresses cleaning-blade chattering and turn-up, thereby providing good image reproduction, as well as to provide a process cartridge and electrophotographic apparatus having the electrophotographic photosensitive member.

The present inventors have conducted intensive studies. As a result, they found the aforementioned problem is effectively achieved and a remarkable effect can be exerted for long time during repeated use by adding a silicon- or fluorine-containing compound to a surface layer of an electrophotographic photosensitive member and forming depressed portions of a predetermined shape on the surface layer. Based on the finding, they have arrived at the present invention.

More specifically, the present invention provides an electrophotographic photosensitive member comprising a support and a photosensitive layer formed on the support and containing a silicon-containing compound or a fluorine-containing compound in a surface layer in an amount of 0.6% by mass or more relative to a total solid matter of the surface layer, characterized in that the electrophotographic photosensitive member has depressed portions which are independent from one another, in a number of from 50 or more to 70,000 or less per unit area (100 μm×100 μm), over the entire region of a surface, and, the depressed portions each have a ratio of a depth (Rdv) that shows a distance between the deepest part of each depressed portion and the opening surface thereof to a major axis diameter (Rpc) of each depressed portion, Rdv/Rpc, of from more than 0.3 to 7.0 or less, and a depth (Rdv) of from 0.1 μm or more to 10.0 μm or less.

The present invention further provides an electrophotographic photosensitive member comprising a support and a photosensitive layer formed on the support and containing a silicon-containing compound or a fluorine-containing compound in a surface layer in an amount of 0.6% by mass or more relative to a total solid matter of the surface layer, the electrophotographic photosensitive member being used in contact with a cleaning blade on the surface thereof, characterized in that the electrophotographic photosensitive member has depressed portions which are independent from one another, in number of from 50 or more to 70,000 or less per unit (100 μm×100 μm), at least over the entire region of a surface portion of the electrophotographic photosensitive member which is in contact with the cleaning blade, and, the depressed portions each have a ratio of a depth (Rdv) that shows a distance between the deepest part of each depressed portion and the opening surface thereof to a major axis diameter (Rpc) of each depressed portion, Rdv/Rpc, of from more than 0.3 to 7.0 or less, and a depth (Rdv) of from 0.1 μm or more to 10.0 μm or less.

The present invention further provides a process cartridge, which has at least the electrophotographic photosensitive member and a cleaning means integrally supported, and is detachably attached to an electrophotographic apparatus main-body, in which the cleaning means has a cleaning blade.

The present invention further provides an electrophotographic apparatus having the electrophotographic photosensitive member, a charging means, an exposure means, a developing means, a transfer means and a cleaning means, in which the cleaning means has a cleaning blade.

The present invention can provide an electrophotographic photosensitive member, which maintains excellent smoothness of the surface thereof and exhibits improved cleaning performance during long-term repeated use, and which suppresses blade chattering and blade turn-up, thereby providing good image reproduction, as well as provides a process cartridge and electrophotographic apparatus having the electrophotographic photosensitive member.

DETAILED DESCRIPTION OF THE INVENTION

Figure 1A:
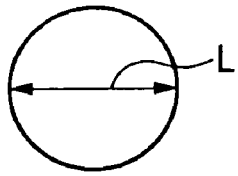
FIG. 1A is a view (top view) illustrating a shape of a depressed portion on the surface of an electrophotographic photosensitive member according to the present invention.
Figure 1B:
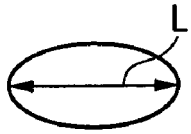
FIG. 1B is a view (top view) illustrating a shape of a depressed portion on the surface of an electrophotographic photosensitive member according to the present invention.
Figure 1C:
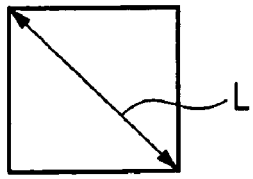
FIG. 1C is a view (top view) illustrating a shape of a depressed portion on the surface of an electrophotographic photosensitive member according to the present invention.
Figure 1D:
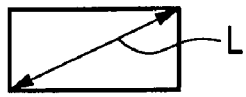
FIG. 1D is a view (top view) illustrating a shape of a depressed portion on the surface of an electrophotographic photosensitive member according to the present invention.
Figure 1E:
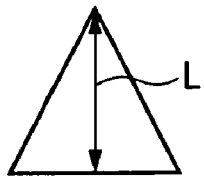
FIG. 1E is a view (top view) illustrating a shape of a depressed portion on the surface of an electrophotographic photosensitive member according to the present invention.
Figure 1F:
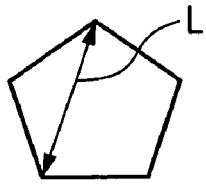
FIG. 1F is a view (top view) illustrating a shape of a depressed portion on the surface of an electrophotographic photosensitive member according to the present invention.
Figure 1G:
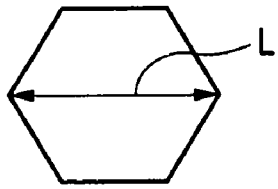
FIG. 1G is a view (top view) illustrating a shape of a depressed portion on the surface of an electrophotographic photosensitive member according to the present invention.
Figure 2A:
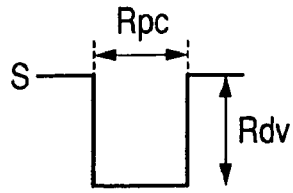
FIG. 2A is a view (sectional view) of a depressed portion on the surface of an electrophotographic photosensitive member according to the present invention.
Figure 2B:
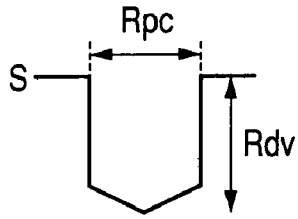
FIG. 2B is a view (sectional view) of a depressed portion on the surface of an electrophotographic photosensitive member according to the present invention.
Figure 2C:
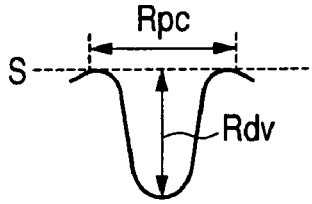
FIG. 2C is a view (sectional view) of a depressed portion on the surface of an electrophotographic photosensitive member according to the present invention.
Figure 2D:
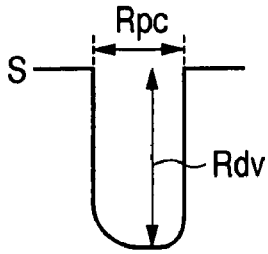
FIG. 2D is a view (sectional view) of a depressed portion on the surface of an electrophotographic photosensitive member according to the present invention.
Figure 2E:
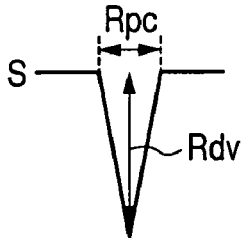
FIG. 2E is a view (sectional view) of a depressed portion on the surface of an electrophotographic photosensitive member according to the present invention.
Figure 2F:
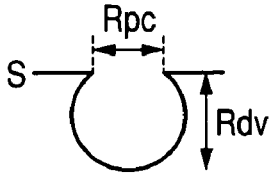
FIG. 2F is a view (sectional view) of a depressed portion on the surface of an electrophotographic photosensitive member according to the present invention.
Figure 2G:
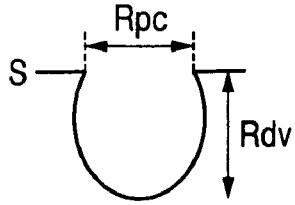
FIG. 2G is a view (sectional view) of a depressed portion on the surface of an electrophotographic photosensitive member according to the present invention.

The present invention will be more specifically described below.

The electrophotographic photosensitive member of the present invention has a photosensitive layer on a support, as described above. The surface layer of the photosensitive layer contains a silicon-containing compound or a fluorine-containing compound. The surface layer of the electrophotographic photosensitive member has, on the surface, a plurality of depressed portions which are independent from one another. When the major axis diameter of the depressed portions is represented by Rpc and the depth, which is the distance between the deepest part of the depressed portion and the opening surface, is represented by Rdv, Rdv is from 0.1 μm or more to 10.0 μm or less, and the ratio of the depth (Rdv) to the major axis diameter (Rpc), that is, Rdv/Rpc, is from more than 0.3 to 7.0 or less.

The depressed portions independently formed in the present invention means individual depressed portions, which are present discretely and distinguishably from one another. The shapes of the depressed portions which are formed on the surface of the electrophotographic photosensitive member of the present invention may include, for example, in the observation of the photosensitive member surface, a shape drawn by linear lines, a shape drawn by a curved line and a shape drawn by linear lines and curved lines in combination. As the shape drawn by linear lines, for example, a triangle, square, pentagon or hexagon may be mentioned. As the shape drawn by a curved line, for example, a circular shape or an ellipse shape may be mentioned. As the shape drawn by linear lines and curved lines in combination, for example, a square with rounded corners, a hexagon with rounded corners or a fan may be mentioned. Furthermore, the shapes of the depressed portions which are formed on the surface of the electrophotographic photosensitive member of the present invention may include, for example, in the observation of the photosensitive member cross section, a shape drawn by linear lines, a shape drawn by a curved line and a shape drawn by linear lines and curved lines in combination. As the shape drawn by linear lines, for example, a triangle, square or pentagon may be mentioned. As the shape drawn by a curved line, for example, a partly circular shape or partly ellipse shape may be mentioned. As the shape drawn by linear lines and curved lines in combination, for example, a square with rounded corners or a fan may be mentioned. Specific examples of shapes of the depressed portions on the surface of the electrophotographic photosensitive member of the present invention are shown in FIGS. 1A to 1G (shape examples of depressed portions (in the observation from the photosensitive member surface)) and in FIGS. 2A to 2G (shape examples of depressed portions (in the observation of the cross section)). The shapes of the depressed portions which are formed on the surface of the electrophotographic photosensitive member of the present invention may have different shapes, sizes or depths. All the depressed portions may have the same shape, size or depth. Alternatively, depressed portions, which have different shapes, sizes or depths, may be present in combination with depressed portions, which have the same shape, size or depth in the surface of the electrophotographic photosensitive member.

The depressed portions are formed at least on the surface of the electrophotographic photosensitive member. The depressed portions to be formed on the surface of a photosensitive member may be formed over the entire region of the surface of the surface layer or on part of the surface.

The major axis diameter used in the present invention, as is represented by the length (L) indicated by a two-headed arrow in FIGS. 1A to 1G and represented by major axis diameter Rpc in FIGS. 2A to 2G, refers to the maximum length of each of the depressed portions formed on the electrophotographic photosensitive member, on the basis of the surface that surrounds an opening portion of the depressed portion of the electrophotographic photosensitive member. For example, when the top-view shape of the depressed portion is a circle, the diameter of the circle is defined as the major axis diameter. When the top-view shape of the depressed portion is an ellipsoid, the major axis of the ellipsoid is defined as the major axis diameter. When the top-view shape of the depressed portion is a rectangle, the longer diagonal line is defined as the major axis diameter.

The depth used in the present invention refers to the distance between the deepest part and the opening surface of each depressed portion. More specifically, as is indicated by depth Rdv in FIGS. 2A to 2G, the depth represents the distance between the deepest part and the opening surface of a depressed portion, on the basis of the surface S that surrounds the opening portion of the depressed portion of the electrophotographic photosensitive member.

In the electrophotographic photosensitive member of the present invention, the surface layer of the electrophotographic photosensitive member contains a silicon-containing compound or a fluorine-containing compound. In addition, on the surface of the photosensitive layer, a plurality of depressed portions is independently formed. Each of the depressed portions has a depth (Rdv) of from 0.1 μm or more to 10.0 μm or less and satisfies a ratio of a depth (Rdv) of depressed portion to a major axis diameter thereof, Rdv/Rpc, of from more than 0.3 to 7.0 or less. The electrophotographic photosensitive member has depressed portions as defined above. When the ratio is less than 0.3, the effect of the photosensitive member is not maintained sufficiently when the member is used repeatedly. This feature varies depending upon the number of paper sheets printed. In contrast, when the ratio is more than 7.0, the surface layer must be formed sufficiently thick. This feature may also vary depending upon the number of paper sheets printed.

By virtue of use of the electrophotographic photosensitive member of the present invention, cleaning performance can be maintained satisfactorily and formation of various defective images is suppressed. The reason has not yet been elucidated; however, it is considered that the friction coefficient is reduced by the presence of the depressed portions of the present invention in the surface of the electrophotographic photosensitive member and the presence of a fluorine-containing compound or a silicon-containing, compound in the surface layer, thereby imparting smoothness to the member. To describe more specifically, the frictional resistance between an electrophotographic photosensitive member and a cleaning blade tends to decrease as the contact area between them reduces owing to the projections and depressions present on the surface of the electrophotographic photosensitive member. However, the cleaning blade itself is an elastic body. Therefore, the cleaning blade may follow up to the surface shape of the electrophotographic photosensitive member to some extent. Accordingly, when the surface shape is not appropriate, a sufficient effect may not be exerted. In the electrophotographic photosensitive member of the present invention, since specific depressed portions are present on the surface of the electrophotographic photosensitive member and a fluorine-containing compound or a silicon-containing compound is present in the surface layer, it is likely possible to suppress the follow-up movement of the cleaning blade to the photosensitive member. By virtue of this, it is considered that the frictional resistance between the electrophotographic photosensitive member and the cleaning blade is drastically reduced. As a result, cleaning performance is improved. Since the good cleaning performance can be maintained not only in the beginning but also during long-term repeated use, formation of various types of defective images may be suppressed.

In the electrophotographic photosensitive member of the present invention, the frictional coefficient between the electrophotographic photosensitive member and the cleaning blade becomes drastically low as described above. Therefore, it is considered that good cleaning performance is maintained without interposing a sufficient amount of developer. Furthermore, in the electrophotographic photosensitive member of the present invention, since specific depressed portions are present on the surface, developer components such as a toner or an external additive can be held within the depressed portions, thereby contributing to good cleaning performance. Although details are unknown, in general, it is considered that good cleaning performance is produced by the interposition of the developer components such as toner or external additive remaining on the surface of the photosensitive member without being transferred, between the cleaning blade and the electrophotographic photosensitive member. In other words, it is considered that, in the prior art, the cleaning performance is made exhibited by making use of part of the developer remaining without being transferred. If the balance is lost, as the case may be, problems such as fusion caused by the developer components having remained and an increase in frictional resistance occur. To be more specific, when a large amount of the remaining developer components without being transferred, such as toner or external additives is present, good cleaning performance is exhibited. However, when a large number of paper sheets are printed with a low printing density or when monochrome printing is continuously made in a tandem electrophotographic system, friction resistance between a cleaning blade and an electrophotographic photosensitive member tends to increase, with the result that the developer components are likely to fuse. This may be because the amount of developer components such as toner or external additives present in the cleaning blade is extremely reduced. In contrast, in the electrophotographic photosensitive member of the present invention, specific depressed portions are formed on the surface layer. The developer components such as toner or external additives can be held in the inside of depressed portions. This is considered to contribute to good cleaning performance. For this reason, even when a large number of paper sheets are printed with a low printing density or when monochrome printing is continuously made in a tandem electrophotographic system, a cleaning failure may rarely occur.

In the surface of the electrophotographic photosensitive member of the present invention, it is preferable that the surface has depressed portions satisfying a ratio of the depth to the major axis diameter, Rdv/Rpc, of from more than 0.3 to 7.0 or less in a number of 50 or more to 70,000 or less per 100 μm squares of the surface of the electrophotographic photosensitive member, that is, per unit area (100 μm×100 μm). The electrophotographic photosensitive member having good cleaning performance is achieved if it has a large number of specific depressed portions per unit area. Furthermore, it is preferable that the surface has depressed portions, each having a depth Rdv showing a distance between the deepest part and the opening surface of depressed portion, of from 0.5 μm or more to 10.0 μm or less and satisfying a ratio of the depth to the major axis diameter, Rdv/Rpc, of from more than 1.0 to 7.0 or less, in view of maintaining an effect for a long time even if the photosensitive member is repeatedly used. Note that a depressed portion that fails to satisfy the aforementioned shape conditions may be present on the unit area.

Furthermore, to increase the service life of an electrophotographic photosensitive member, it is preferred that the depth (Rdv) of a depressed portion is from more than 3.0 μm to 10.0 μm or less. When the depth (Rdv) of a depressed portion is more than 3.0 μm, an effect thereof can be maintained to the end of the service life even in a long-life photosensitive member. Moreover, it is preferred that the ratio of the depth to the major axis diameter (Rdv/Rpc) is from more than 1.5 to 7.0 or less, in view of good cleaning properties. On the other hand, when the depth (Rdv) of the depressed portions exceeds 10.0 μm, localized discharge occurs, which may degrade the surface layer of the photosensitive member upon conduction of electric current. Consequently, image property may deteriorate.

As is described above, it is preferred that the depth (Rdv) of a depressed portion and a ratio (Rdv/Rpc), which is a ratio of the depth to the major axis diameter, may be arbitrarily set within the scope of the present invention depending upon the lifetime of an electrophotographic photosensitive member, in view of providing good cleaning performance to the end of the predetermined lifetime of a photosensitive member.

The depressed portions, which satisfy a ratio of the depth to the major axis diameter (Rdv/Rpc) of from more than 0.3 to 7.0 or less, may be arbitrarily arranged on the surface of the electrophotographic photosensitive member of the present invention. To describe more specifically, the depressed portions, which satisfy a ratio of the depth to the major axis diameter (Rdv/Rpc) of from more than 0.3 to 7.0 or less, may be arranged at random or at regular intervals. To improve uniformity of the surface involved in cleaning performance, the depressed portions are preferably arranged at regular intervals.

In the present invention, the depressed portions on the surface of the electrophotographic photosensitive member can be measured by, for example, a commercially available laser microscope, an optical microscope, an electron microscope or an atomic force microscope.

Examples of the laser microscope that may be used include a super-depth configuration determination microscope VK-8550, a super-depth configuration determination microscope VK-9000 and a super-depth configuration determination microscope VK-9500 (all manufactured by Keyence Corporation); a surface configuration measurement system Surface Explorer SX-520DR type (manufactured by Ryoka Systems Inc.); a scanning confocal laser microscope OLS3000 (manufactured by Olympus Corporation); and a real color confocal microscope Optelics C130 (manufactured by Lasertech Corporation).

Examples of the optical microscope that may be used include a digital microscope VHX-500 and a digital microscope VHX-200 (both manufactured by Keyence Corporation) and a 3D digital microscope VC-7700 (manufactured by Omron Corporation).

Examples of the electron microscope that may be used include a 3D real surface-view microscope VE-9800 and a 3D real surface-view microscope VE-8800 (both manufactured by Keyence Corporation); a scanning electron microscope conventional/Variable Pressure SEM (manufactured by SII Nano Technology Inc.); and a scanning electron microscope SUPERSCAN SS-550 (manufactured by Shimadzu Corporation).

Examples of the atomic force microscope that may be used include a nano-scale hybrid microscope VN-8000 (manufactured by Keyence Corporation); a scanning probe microscope NanoNavi station (manufactured by SII Nano Technology Inc.); and a scanning probe microscope SPM-9600 (manufactured by Shimadzu Corporation).

Using any one of the microscope, the major axis diameter and depth of a depressed portion can be measured within the filed of view at a predetermined magnification. Furthermore, the ratio of the opening portion area of the depressed portions per unit area can be obtained by calculation.

As an example, a case where measurement is performed by a Surface Explorer SX-520DR in combination with an analysis program will be described. The electrophotographic photosensitive member to be measured is placed on a workpiece-holder and horizontarized by adjusting the tilt. Then, data of the three-dimensional shape of the circumference surface of the electrophotographic photosensitive member is taken by a Web mode. At this time, the magnification of an objective lens may be set at 50×. Observation may be made in a field of view having an area of 100 μm×100 μm (10,000 $\mu m^2$).

Next, using a particle analysis program of the data analysis software, the surface of electrophotographic photosensitive member is displayed by contour-line drawing.

The analysis parameters of a depressed portion such as a shape, a major axis diameter, a depth and an opening-portion area of the depressed portion can be optimized depending upon the depressed portion formed. For example, when a depressed portion having a major axis diameter of about 10 μm is observed and measured, the upper limit of the major axis diameter may be set at 15 μm, the lower limit at 1 μm, the lower limit of the depth at 0.1 μm and the lower limit of the volume at 1 $\mu m^3$. Then, the number of depressed portions that can be distinguished as a depressed portion on the analysis screen is counted. This numerical value is determined as the number of depressed portions.

Furthermore, in the same analysis conditions including a field of view as mentioned above, the total area of the opening portions of depressed portions may be calculated from the total areas of opening-portions of depressed portions obtained with the particle analysis program and an opening-portion area ratio of the depressed portions (hereinafter, the term "area ratio" will represent the opening-portion area ratio) may be calculated by the following equation.

(Total opening-portion area of the depressed portions/ total opening-portion area of the depressed portions+total area of non-depressed portions)× 100 [%]

Note that a depressed portion having a major axis diameter of about 1 μm or less can be observed by a laser microscope and an optical microscope; however, desirably at the same time the depressed portion may be observed and measured by an electron microscope to increase accuracy of measurement.

Next, a method of forming the surface of an electrophotographic photosensitive member according to the present invention will be described. The method of forming the surface shape may not be particularly limited as long as it can satisfy the aforementioned requirements for the depressed portions. As examples of the method of forming the surface of the electrophotographic photosensitive member, mention may be made of a method of forming the surface of an electrophotographic photosensitive member by irradiation of a laser having an output characteristic: a pulse width: 100 ns (nano-seconds) or less; a method of forming the surface by bringing a mold having a predetermined shape into pressure contact with the surface of an electrophotographic photosensitive member, thereby transferring the shape to the surface; and a method of forming the surface by inducing moisture condensation on the surface when the surface layer of an electrophotographic photosensitive member is formed.

The method of forming the surface of an electrophotographic photosensitive member by irradiation of a laser having an output characteristic: a pulse width: 100 ns (nano-seconds) or less, will be described. Specific examples of the laser to be used in the method include an excimer laser using a gas such as ArF, KrF, XeF or XeCl as a medium and a femtosecond laser using titanium sapphire as a medium. Furthermore, the wavelength of the laser light upon the irradiation of laser is preferably 1000 nm or less.

The excimer laser is a laser light generated through the following steps. First, to a gas mixture including a rare gas such as Ar, Kr or Xe and a halogen gas such as F or Cl, energy is applied by use of electric discharge, electron beam or X-rays to excite the aforementioned elements and combine them. Thereafter, when they go back to the ground state, they are dissociated to generate an excimer laser. Examples of the gas to be used for generating an excimer laser include ArF, KrF, XeCl and XeF. Any one of the gases may be used. In particular, KrF and ArF are preferable.

Figure 3:
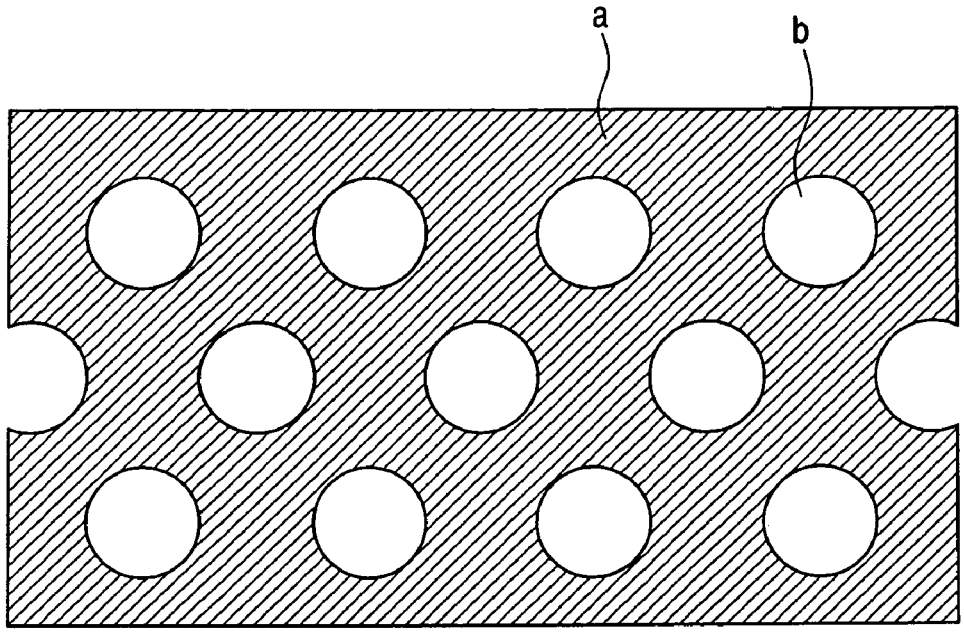
FIG. 3 is a view (partly enlarged view) illustrating an arrangement pattern of a mask to be used in the present invention.
Figure 4:
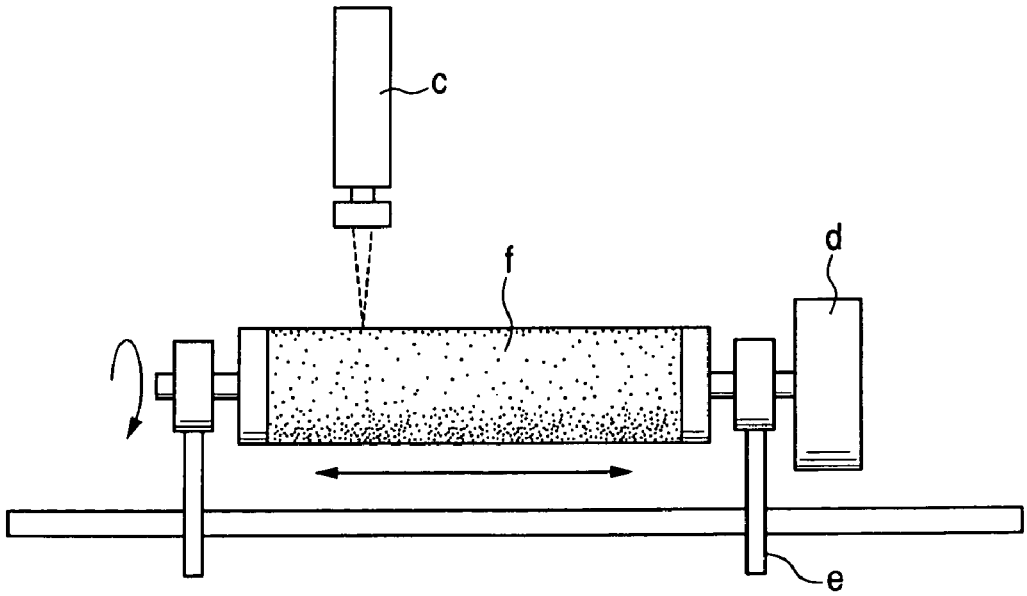
FIG. 4 is a schematic view illustrating a laser processing machine to be used in the present invention.

Depressed portions are formed by a method of using a mask in which laser-beam shielding portions a and laser-beam transmitting portions b are appropriately arranged as shown in FIG. 3. Only the laser beams transmitted through the mask were converged by a lens and applied to the surface of an electrophotographic photosensitive member. In this manner, depressed portions having a desired shape can be formed and desirably arranged. In the aforementioned method for forming the surface of an electrophotographic photosensitive member by laser irradiation, numerical depressed portions can be momentary and simultaneously formed within a predetermined area regardless of the shapes and areas of the depressed portions. Therefore, the step of forming the surface can be performed in a short time. By a single irradiation of laser through a mask, the area of several $mm^2$ to several $cm^2$ of an electrophotographic photosensitive member surface can be processed. In the laser processing, as shown in FIG. 4, an electrophotographic photosensitive member f is first rotated on its axis by work rotation motor d. While rotating, a work moving unit e is operated such that the laser-application position of the excimer laser-light irradiation apparatus c slidably moves along the shaft direction of the electrophotographic photosensitive member f. In this manner, depressed portions can be formed efficiently over the entire region of the surface of the electrophotographic photosensitive member.

By virtue of the aforementioned method for forming the surface of an electrophotographic photosensitive member by laser irradiation, it is possible to form an electrophotographic photosensitive member having, on the surface, a plurality of independent depressed portions, which have a value of Rdv of from 0.1 μm or more to 10.0 μm or less and an Rdv/Rpc ratio (ratio of the depth to the major axis diameter) of from more than 0.3 to 7.0 or less, where the major axis diameter of the depressed portions is represented by Rpc and the depth, that is, the distance between the deepest part and the opening surface of the depressed portion is represented by Rdv. The depth of the depressed portion can be arbitrarily set within the aforementioned range. When the surface of an electrophotographic photosensitive member is formed by laser irradiation, the depth of the depressed portions can be regulated by controlling manufacturing conditions such as laser irradiation time and the number of irradiation times. In view of manufacturing accuracy or productivity, the depth of a depressed portion to be formed by a single irradiation is desirably 0.1 μm or more to 2.0 μm or less when the surface of an electrophotographic photosensitive member is formed by laser irradiation. By virtue of a method of forming the surface of an electrophotographic photosensitive member by laser irradiation, the surface of an electrophotographic photosensitive member can be processed with high accuracy and high degree of freedom while highly accurately controlling the size, shape and arrangement of depressed portions.

Figure 5:
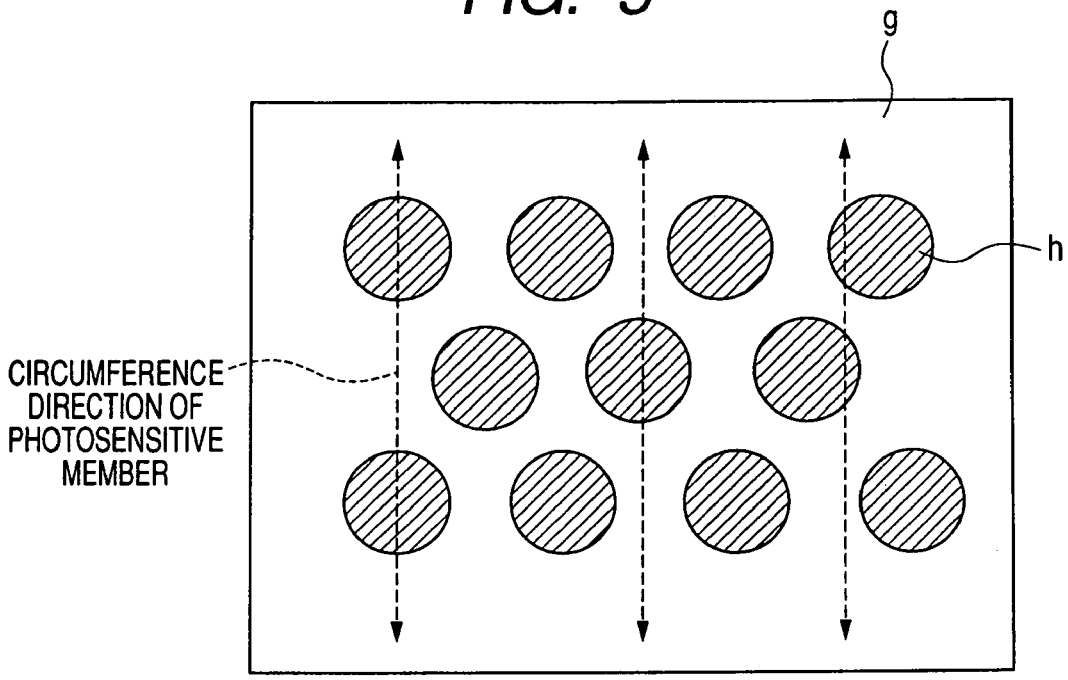
FIG. 5 is a view (partly enlarged view) illustrating an arrangement pattern of depressed portions on the outermost surface of a photosensitive member obtained by the present invention.

In the method of forming the surface of an electrophotographic photosensitive member by laser irradiation, the surface formation method may be applied to a plurality of sites or the entire surface region of a photosensitive member with the same mask pattern used in combination. By this method, depressed portions can be formed highly uniformly over the entire surface of the photosensitive member. As a result, a mechanical load is uniformly applied upon the cleaning blade when the photosensitive member is used in an electrophotographic apparatus. Furthermore, as shown in FIG. 5, if a mask pattern is formed such that both depressed portions h and non depressed-portion formation region g are present along any circumferential direction (indicated by a broken line) of the photosensitive member, it is possible to further prevent a mechanical load from being locally applied upon the cleaning blade.

Next, the method of forming a surface by bringing a mold having a predetermined shape into pressure contact with the surface of an electrophotographic photosensitive member, thereby transfer the shape, will be described.

Figure 6:
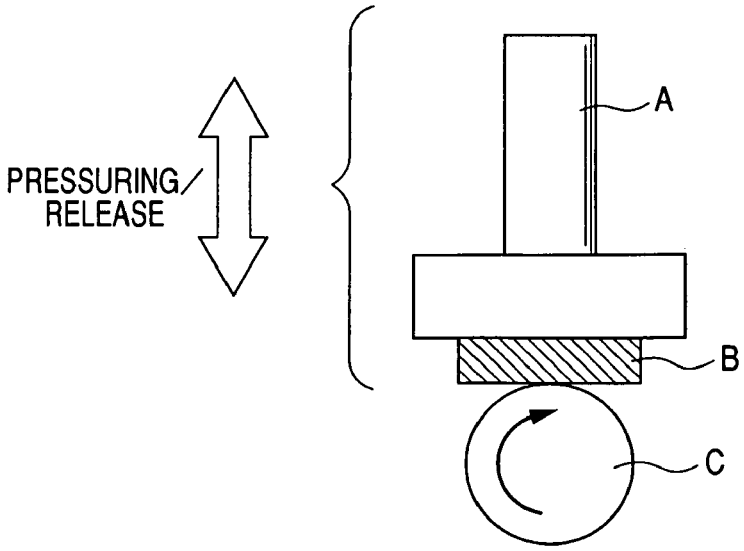
FIG. 6 is a schematic view of a pressure-contact type shape transfer surface processing unit for transferring a shape of a mold, to be used in the present invention.

FIG. 6 is a schematic view illustrating a pressure-contact type shape transfer surface processing unit making use of a mold used in the present invention. After a predetermined mold B is attached to a pressurizing unit A, which can repeatedly apply or release pressure, the mold is brought into contact with a photosensitive member C by application of a predetermined pressure, thereby transferring a shape. Thereafter, the pressure is once released and the photosensitive member C is rotated in the direction indicated by the arrow. Then, pressure is applied again to perform a step of transferring a shape. This step is repeatedly performed to form predetermined depressed portions over the entire circumference of the photosensitive member.

Figure 7:
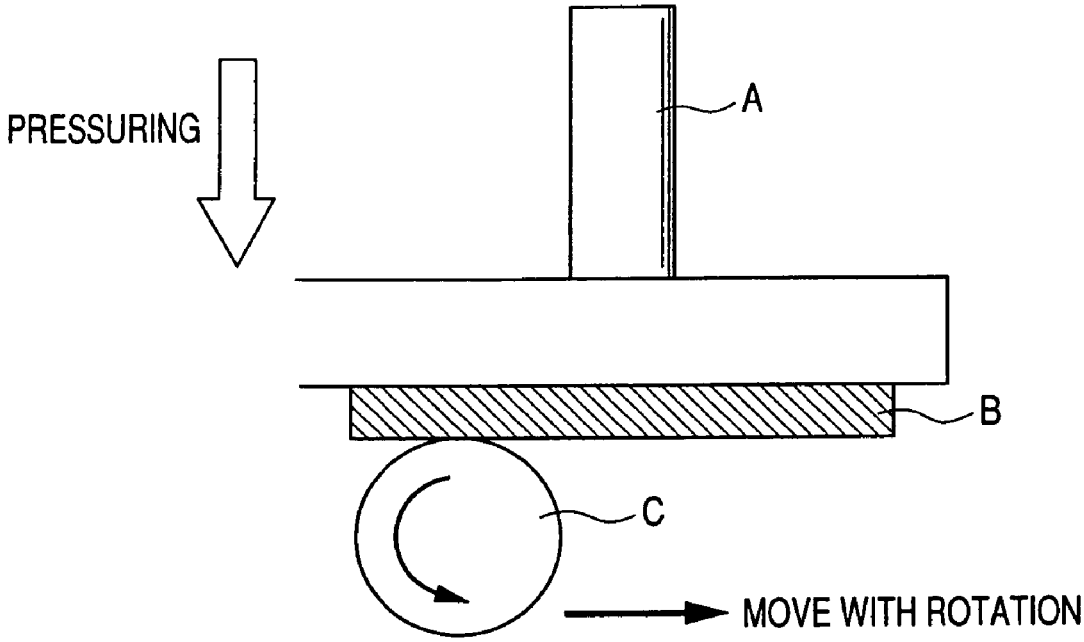
FIG. 7 is a schematic view of another pressure-contact type shape transfer surface processing unit for transferring a shape of the mold, to be used in the present invention.

Furthermore, for example, as shown in FIG. 7, after a mold B having a predetermined shape approximately corresponding to the entire circumference of a photosensitive member C is attached to a pressurizing unit A, the photosensitive member C may be allowed to rotate and move as indicated by the arrow while applying a predetermined pressure to the photosensitive member C to form the predetermined shape over the entire circumference of the photosensitive member.

Alternatively, a sheet-shaped mold may be used so as to be sandwiched between a roll-shaped pressurizing apparatus and a photosensitive member. The surface of the photosensitive member can be processed by making the sheet-shaped mold to proceed.

To efficiently perform the transfer of a shape, a mold and a photosensitive member may be heated. The mold and photosensitive member may be heated at any temperature as long as predetermined depressed portions according to the present invention can be formed; however, they may be preferably heated such that the temperature (° C.) of a mold during a period of shape-transfer operation is higher than the glass transition temperature (° C.) of the photosensitive layer formed on the support. In addition to heating the mold, the temperature (° C.) of the support during the period of shape-transfer operation may be controlled so as to be lower than the grass transition temperature (° C.) of the photosensitive layer. This is preferable in stably forming depressed portions transferred to the surface of the photosensitive member.

Furthermore, when a photosensitive member according to the present invention has a charge transport layer, heating is preferably performed such that the temperature (° C.) of a mold during a period of shape-transfer operation is higher than the grass transition temperature (° C.) of the charge transport layer formed on a support. In addition to heating the mold, the temperature (° C.) of the support during the period of shape-transfer operation is controlled so as to be lower than the grass transition temperature (° C.) of the charge transport layer. This is preferable in stably forming depressed portions transferred to the surface of the photosensitive member.

Figure 8A:
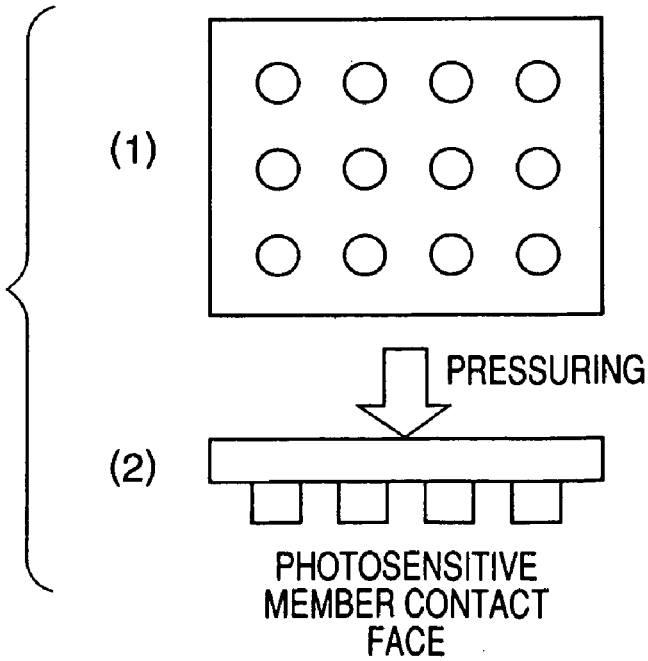
FIG. 8A is a view illustrating a shape of the mold to be used in the present invention.
Figure 8B:
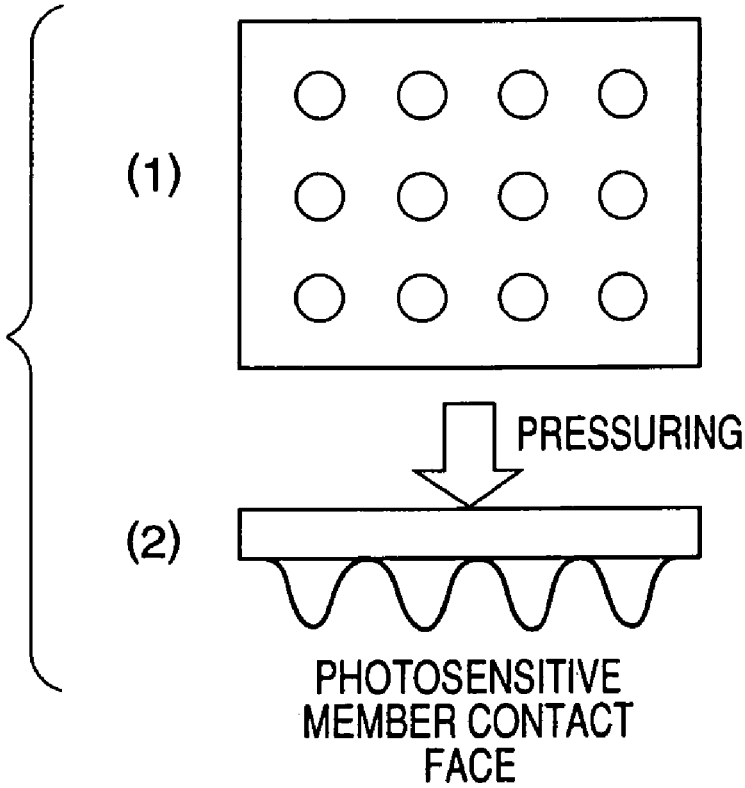
FIG. 8B is a view illustrating another shape of the mold to be used in the present invention.

The material, size and shape of the mold itself may be appropriately selected. As the material, mention may be made of a finely surface-processed metal, a silicon wafer having a resist-patterned surface, a resin film having fine particles dispersed therein, and a resin film having a predetermined fine surface shape and coated with a metal. Examples of the mold shape are shown in FIGS. 8A and 8B. FIGS. 8A and 8B are each a partly enlarged view of the surface of a mold to be in contact with a photosensitive member. View (1) is the shape of a mold as viewed from the top and view (2) is the shape of a mold as viewed from a side.

To apply pressure uniformly to a photosensitive member, an elastic body may be interposed between the mold and a pressurizing unit.

By virtue of a method of forming a surface by transferring a shape by bringing a mold having a predetermined shape as mentioned above into contact with the surface of an electrophotographic photosensitive member, it is possible to manufacture an electrophotographic photosensitive member having a plurality of depressed portions which are independently formed with one another on the surface layer and has a Rdv of from 0.1 μm or more to 10.0 μm or less and a ratio of Rdv/Rpc (ratio of the depth to the major axis diameter) of from more than 0.3 to 7.0 or less, where the major axis diameter of the depressed portions is represented by Rpc and the depth which shows the distance between the deepest part of the depressed portion and opening surface thereof is represented by Rdv. The depth of the depressed portions may be arbitrarily set within the aforementioned range. However, when the surface of an electrophotographic photosensitive member is formed by bringing a mold having a predetermined shape into contact with the surface, thereby transferring the shape, the depth is desirably from 0.1 μm or more to 10.0 μm or less. By virtue of employing a method of forming the surface of an electrophotographic photosensitive member by bringing a mold having a predetermined shape into contact with the surface, thereby transferring the shape, the surface of an electrophotographic photosensitive member can be processed with high accuracy and high degree of freedom while accurately controlling size, shape and arrangement of depressed portions.

Next, the method of forming a surface of an electrophotographic photosensitive member by inducing moisture condensation on the surface when the surface layer thereof is formed, will be described. The method of forming a surface of an electrophotographic photosensitive member by inducing moisture condensation on the surface is a method for manufacturing an electrophotographic photosensitive member characterized by forming the surface layer having depressed portions independently formed on the surface through the following steps: a coating step of applying a surface-layer coating solution which contains a binder resin and a specific aromatic organic solvent, the aromatic organic solvent being in an amount of 50% by mass or more to 80% by mass or less relative to the total amount of solvents contained in the surface-layer coating solution; a moisture condensation step of inducing moisture condensation on the surface of a support coated with the coating solution while holding the support coated with the coating solution; and a drying step for drying the support with heat.

Examples of the binder resin may include an acrylic resin, a styrene resin, a polyester resin, a polycarbonate resin, a polyarylate resin, a polysulfone resin, a polyphenylene oxide resin, an epoxy resin, a polyurethane resin, an alkyd resin and an unsaturated resin. A particularly preferable resin is a polymethylmethacrylate resin, a polystyrene resin, a styrene-acrylonitrile copolymer resin, a polycarbonate resin, a polyarylate resin or a diallyl phthalate resin. Further preferable resin is a polycarbonate resin or a polyarylate resin. These may be used singly, in combination, or as a copolymer of two or more types.

The predetermined aromatic organic solvent mentioned above is a solvent having low affinity with water. Mention specifically made of 1,2-dimethylbenzene, 1,3-dimethylbenzene, 1,4-dimethylbenzene, 1,3,5-trimethyl benzene or chlorobenzene.

It is important to contain an aromatic organic solvent in the surface-layer coating solution. However, in order to stably form depressed portions, an organic solvent having high affinity with water or water may be contained in the surface-layer coating solution. As the organic solvent having high affinity with water, mention may be preferably made of (methylsulfinyl)methane (trivial name: dimethylsulfoxide), thiolane-1,1-dione (trivial name: sulfolane), N,N-dimethylcarboxyamide, N,N-diethylcarboxyamide, dimethylacetamide or 1-methylpyrrolidin-2-on. These organic solvents may be contained singly or in a mixture of two or more types.

The step of holding a support for inducing moisture condensation on the surface thereof as mentioned above is a step of holding the support coated with a surface-layer coating solution under an atmosphere where moisture condensation can be induced on the surface of the support for a predetermined time. The moisture condensation in this surface-forming method refers to formation of droplets on the support coated with a surface-layer coating solution by function of water. Conditions for inducing moisture condensation on the surface of the support are influenced by the relative humidity of the atmosphere surrounding a support and vaporization conditions (e.g., vaporization heat) of solvents contained in a coating solution. Since an aromatic organic solvent is contained in an amount of not less than 50% by mass relative to the total amount (by mass) of solvent in a surface-layer coating solution, the vaporization conditions of the solvent of the coating solution has little effect.

Therefore, conditions for inducing the moisture condensation vary primarily depending upon the relative humidity of the atmosphere where a support is held. The relative humidity for inducing moisture condensation on the surface of a support is 40% to 100%, and more preferably, 70% or more. The step of holding a support may be performed for a time period enough to form droplets by the moisture condensation. The time period is preferably 1 to 300 seconds, and more preferably, about 10 to 180 seconds in view of productivity. Although a relative humidity is important in the step of holding a support, the ambient temperature for the step is preferably 20° C. or more to 80° C. or less.

In the drying step for drying a support with heat, droplets formed on the surface of the support in the step of holding the support can be made into depressed portions formed on the surface of a photosensitive member. To form the depressed portions with high uniformity, quick drying is important and therefore heat drying is performed.

The drying temperature employed in the drying step is preferably 100° C. to 150° C. As the time for the drying step with heating, any time period is acceptable as long as the solvents of the coating solution applied on a support and water drops formed in the moisture condensation step are removed. The time for the drying step is preferably 10 to 120 minutes, and more preferably, 20 to 100 minutes.

By virtue of the method of forming a surface by inducing moisture condensation on the surface when the surface layer of an electrophotographic photosensitive member is formed, depressed portions are formed independently on the surface of the photosensitive member. In the method of forming a surface by inducing moisture condensation on the surface when the surface layer of an electrophotographic photosensitive member is formed, droplets formed by the function of water are formed into depressed portions by use of a solvent having low affinity with water and a binder resin. Individual shapes of the depressed portions formed on the surface of the electrophotographic photosensitive member in accordance with this manufacturing method are quite uniform since they are formed by the cohesive force of water. Since the manufacturing method includes the step of removing droplets, or removing droplets from a state that the droplets have sufficiently grown, the depressed portions on the surface of an electrophotographic photosensitive member are formed in the shape of droplets or honeycomb (hexagonal shape). The depressed portions in the shape of droplets refer to depressed portions looking, e.g., circular or elliptic in observation of the photosensitive member surface and depressed portions looking, e.g., partially circular or partially elliptic in observation of the photosensitive member cross section. The depressed portions in the shape of honeycombs (hexagonal shape) are, e.g., depressed portions formed as a result of closest packing of droplets on the surface of the electrophotographic photosensitive member. Stated specifically, they refer to depressed portions looking circular, hexagonal or hexagonal with round corners in observation of the photosensitive member surface and depressed portions looking, e.g., partially circular or square pillared in observation of the photosensitive member cross section.

By virtue of the method of forming a surface by inducing moisture condensation on the surface when the surface layer of an electrophotographic photosensitive member is formed, it is possible to form an electrophotographic photosensitive member having a plurality of depressed portions which are independently formed with one another on the surface layer and has a value of Rdv of from 0.1 μm or more to 10.0 μm or less and a ratio of Rdv/Rpc (ratio of the depth to the major axis diameter) of from more than 0.3 to 7.0 or less, where the major axis diameter of the depressed portion is represented by Rpc and the depth which shows the distance between the deepest part of the depressed portion and opening surface thereof is represented by Rdv. The depth of the depressed portion may be arbitrarily set within the aforementioned range. However, it is preferred to employ manufacturing conditions under which the depth of the depressed portion falls within the range of from 0.1 μm or more to 20 μm or less.

Figure 15:
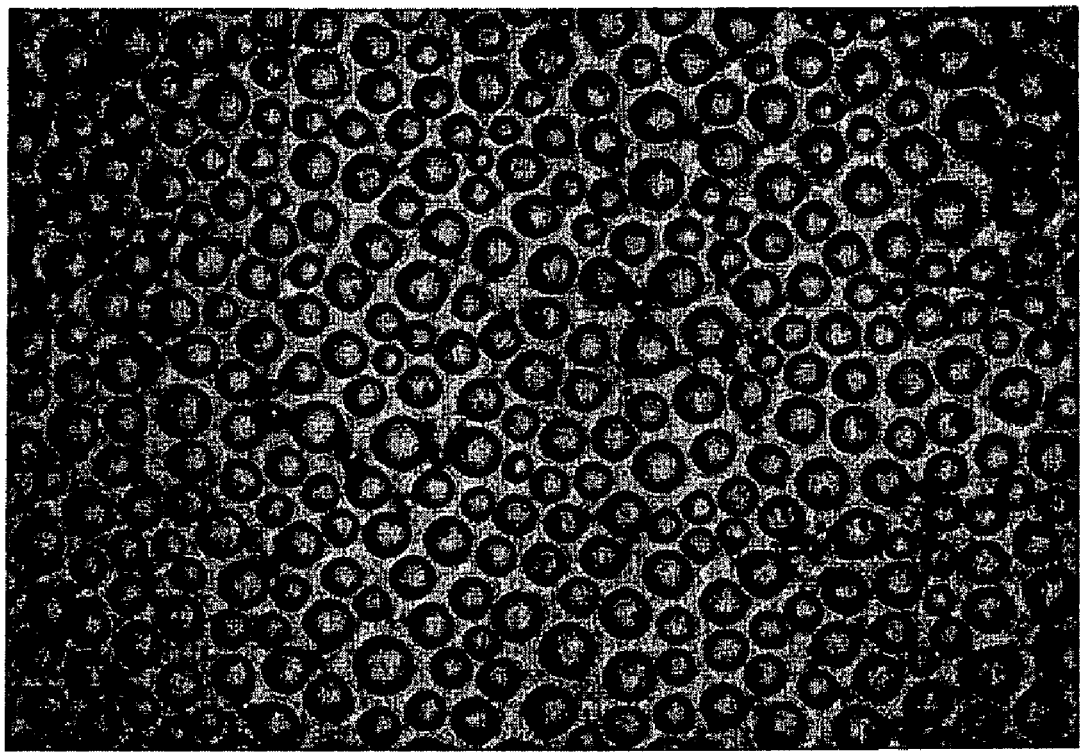
FIG. 15 is a laser-micrographic image of the depressed portions on the surface of the photosensitive member prepared in Example 23.

The depressed portions can be controlled by appropriately setting the manufacturing conditions within the range shown in the manufacturing method. For example, the depressed portions can be controlled by types and contents of solvents contained in the surface-layer coating solution described in this specification, the relative humidity in the moisture condensation step, the time period for holding a substrate in the moisture condensation step, and the temperature of the heat drying step. The depressed portions which are formed by inducing moisture condensation on the surface when the surface layer of the electrophotographic photosensitive member is formed are observed by a laser microscope. An example of the image thereof is shown in FIG. 15.

Furthermore, in the present invention, as a silicon-containing compound or a fluorine-containing compound contained in the surface layer of an electrophotographic photosensitive member, any compound may be used as long as a silicon or fluorine element is contained in the structure of the compound. As an example of the silicon-containing compound, a polysiloxane may be mentioned, which has a structural repeat unit represented by Formula (1):

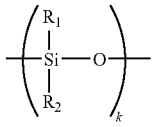

(1)

where $R_1$ and $R_2$ may be the same or different and represent a hydrogen atom, a halogen atom, an alkoky group, a nitro groups, a substituted or unsubstituted alkyl group, or a substituted or unsubstituted aryl group; and k represents a positive integer from 1 to 500.

Figure 9:
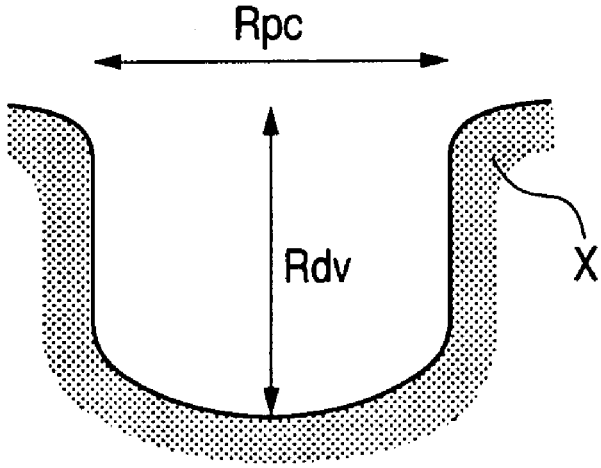
FIG. 9 is a conceptual view illustrating a distribution of a fluorine-containing compound or a silicon-containing compound in a depressed portion on the surface of a photosensitive member obtained by the present invention.

In this case, use may be made of dimethyl silicone oil having a, methyl group at an, end and a side chain, or various types of modified silicone oil in order to increase compatibility with a binder resin. In addition, a modified polysiloxane having a repeat unit (Si—O) at a side chain, an end and a part of the main chain shows high surface migration property when the surface layer is formed although the degree of the surface migration property varies depending upon the compatibility with a binder resin and the structure thereof. If such a modified polysiloxane is employed in combination with the depressed portions of the present invention, a large amount of fluorine-containing compound or a silicon-containing compound is distributed in the inner surface of the depressed portions, as shown in FIG. 9 (in which X indicates the portion where a fluorine-containing compound or a silicon-containing compound is localized). This is preferable from the following perspectives. When the surface layer of a photosensitive member is abraded by repeated use, a new surface becomes constantly exposed out of the depressed portions. Thus, the lubricity of fluorine-containing compound or silicon-containing compound can always be kept exhibited up to the end of service life of a photosensitive member during repeated use. As a result, the prolonged effect upon the cleaning performance can be achieved.

The degree of distribution of a fluorine-containing compound or a silicon-containing compound in the outermost surface of the surface layer can be determined by measuring the ratio of a fluorine element or a silicon element present in the outermost surface. To describe more specifically, by using X-ray photoelectron spectroscopy (ESCA) are measured the content A (% by mass) of a fluorine element or a silicon element present in a portion 0.2 μm inward from the outermost surface of the surface layer of a photosensitive member and the content B (% by mass) of a fluorine element or a silicon element present in the outermost surface of the surface layer of the photosensitive member to obtain a ratio of the former and the latter (A/B).

If the ratio is smaller than 0.5, a fluorine-containing compound or a silicon-containing compound is judged to migrate to the outermost surface of the surface layer and be present there in a concentrated state. In this respect, the ratio A/B is preferably smaller than 0.5 and larger than 0.0 in the present invention. It is preferred that the ratio of a fluorine element or a silicon element relative to the elements constituting the outermost surface of the surface layer is 1.0% by mass or more because the effect of such a compound upon the cleaning performance can be easily produced.

Furthermore, when the ratio is smaller than 0.1, it is considered that a fluorine-containing compound or a silicon-containing compound is localized only in the proximity of the outermost surface of the surface layer of the photosensitive member. When this is combined with a surface layer having depressed portions which satisfy a ratio of the depth to the major axis diameter (Rdv/Rpc) of from more than 0.3 to 7.0 or less, a high lubricity of a fluorine-containing compound or a silicon-containing compound can be maintained exhibited to the maximum and as a result, more prolonged effect on the cleaning performance can be achieved advantageously.

At that time, in view of the fact that the area to be measured by X-ray photoelectron spectroscopy (ESCA) is limited to about 100μ, measurement can be performed without forming the depressed portions in the electrophotographic photosensitive member, thereby making necessary measurements of the outermost surface of the photosensitive member and a portion 0.2μ inward from the outermost surface.

The contents of a fluorine element or a silicon element in the outermost surface of a photosensitive member surface layer and in a portion 0.2 μm inward from the outermost surface were measured by X-ray photoelectron spectroscopy (ESCA) as follows.

Apparatus used: Quantum 2000 Scanning ESCA Microprobe manufactured by PHI Inc. (Physical Electronics Industries, Inc.)

Measurement conditions for the outermost surface and the portion 0.2 μm inward (after etching):

X-ray source: Al Kal486.6 eV (25W15 kV),

Measurement area: 100 μm

Spectrum region: 1500×300 μm, Angle 45°

Pass Energy: 117.40 eV

Etching conditions:

Ion gun C60 (10 kV, 2 mm×2 mm), Angle 70°

Note that the rate of 1.0 μm/100 min was required for etching to a depth of 1.0 μm of a charge transport layer (after the charge transport layer was etched, the depth was determined under SEM observation of the section). From this, the analysis of elements present in a portion 0.2 μm inward from the outermost surface can be carried out by performing etching for 20 minutes using an ion gun C60.

Based on the peak intensity of each element measured under the aforementioned conditions, surface atomic concentration (atom %) is computationally obtained by use of a relative sensitivity factor provided by PHI Inc. The measured peak-top ranges of individual elements constituting the surface layer are as follows:

C1s: 278 to 298 eV

F1s: 680 to 700 eV

Si2p: 90 to 110 eV

O1s: 525 to 545 eV

N1s: 390 to 410 eV.

Preferable examples of a fluorine-containing compound or a silicon-containing compound to be used in the present invention will be described below; but the compound is not limited to these.

As the fluorine-containing compound, fluorine oil may be mentioned. As the fluorine oil, for example, perfluoropolyether oil having a straight-chain structure may be mentioned, which is perfluoropolyether oil: Demnum S-100, (manufactured by Daikin Industries Ltd.). Perfluoropolyether oil having an average molecular weight (Mw) of 2,000 to 9,000 is preferable.

As the silicon-containing compound, aforementioned silicone oils (such as dimethylsilicone and modified silicone) may be mentioned. Examples of the silicone oils include: dimethylpolysiloxane (KF96 manufactured by Shin-Etsu Silicone); amino-modified polysiloxane (X-22-161B manufactured by Shin-Etsu Silicone); epoxy-modified polysiloxane (X-22-163A manufactured by Shin-Etsu Silicone); carboxy-modified polysiloxane (X-22-3710 manufactured by Shin-Etsu Silicone); carbinol-modified polysiloxane (KF6001 manufactured by Shin-Etsu Silicone); mercapto-modified polysiloxane (X-22-167B manufactured by Shin-Etsu Silicone); phenol-modified polysiloxane (BY16-752 manufactured by Dow Corning Toray Silicone Co., Ltd.); polyether-modified polysiloxane (KF618 manufactured by Shin-Etsu Silicone); aliphatic ester-modified polysiloxane (KF910 manufactured by Shin-Etsu Silicone); and alkoxy-modified polysiloxane (FZ3701 manufactured by Nippon Unicar Co., Ltd.). Silicone oils having a weight-average molecular weight (Mw) of 1,000 to 100,000 are preferable. These fluorine-containing compounds or silicon-containing compounds may be used singly or in a mixture of two types or more.

In the present invention, the incorporation of a fluorine-containing compound or a silicon-containing compound into a surface layer of a photosensitive member is combined with the formation of depressed portions on the surface layer, thereby achieving prolonged lubricity and obtaining good cleaning performance, compared with the prior arts, even if the content of a fluorine-containing compound or silicon-containing compound is 0.6% by mass or more relative to the total solid matter of the surface layer and even if the photosensitive member is repeatedly used. Preferably, the content of the fluorine-containing compound or silicon-containing compound is 0.6% by mass or more to 10.0% by mass or less relative to the total solid matter of the surface layer. This is because sufficient lubricity can be easily obtained when the content is 0.6% by mass or more; and on the other had, when the content is 10.0% by mass or less, the strength of the surface layer can be sufficiently maintained, thereby suppressing an abrasion amount of photosensitive member surface and extending the service life thereof for a long period of time although it depends upon the type of binder resin to be blended to the surface layer.

Specific examples of the aforementioned modified polysiloxane having a repeat unit (Si—O) at a side chain or an end and a part of the main chain may include any one of polycarbonate, polyester, acrylate, methacrylate and styrene, having a siloxane structure or a polymer having a plurality of these.

As the polymer having a siloxane structure at a side chain, for example, styrene-polydimethylsiloxane methacrylate (Aron GS-101CP, manufactured by Toagosei Co., Ltd.) may be mentioned.

As the polycarbonate or polyester polymer having a siloxane structure, a polycarbonate or polyester polymer having a structural repeat unit represented by Formula (4) and a structural repeat unit represented by Formula (2) or (3) may be mentioned.

(2)

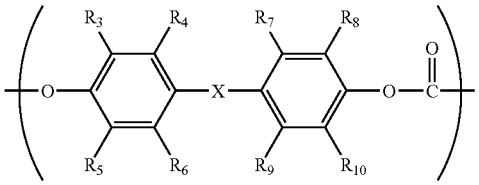

(3)

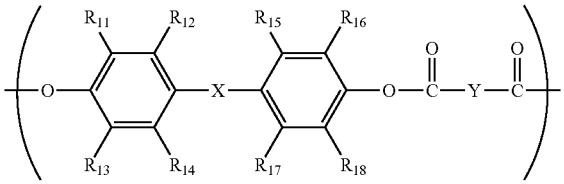

In the Formulas (2) and (3), X and Y represent a single bond, —O—, —S—, substituted alkylidene group or an unsubstituted alkylidene group; $R_3$ to $R_{18}$ may be the same or different and represent a hydrogen atom, a halogen atom, an alkoxy group, a nitro group, a substituted alkyl group, an unsubstituted alkyl group, a substituted aryl group or an unsubstituted aryl group.

(4)

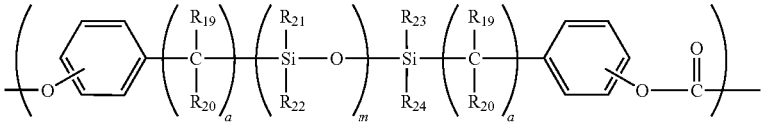

where $R_{19}$ and $R_{20}$ represent a hydrogen atom, an alkyl group or an aryl group; $R_{21}$ to $R_{24}$ may be the same or different and represent a hydrogen atom, a halogen atom, a substituted alkyl group, an unsubstituted alkyl group, a substituted aryl group or an unsubstituted aryl group; a represents an integer from 1 to 30; and m represents an integer from 1 to 500.

Of the polycarbonates or polyester polymers having a siloxane structure, a polycarbonate or polyester polymer having a structural repeat unit represented by aforementioned Formula (4) and a structural repeat unit represented by aforementioned Formula (2) or (3) and having a structure represented by Formula (5) at one of the ends or both ends is more preferable.

(5)

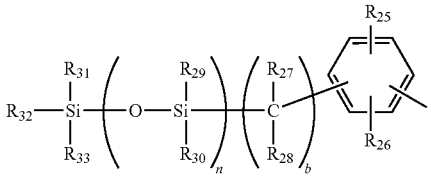

where $R_{25}$ and $R_{26}$ represent a hydrogen atom, a halogen atom, an alkoxy group, a nitro group, an unsubstituted alkyl group, a substituted alkyl group, an unsubstituted aryl group or a substituted aryl group; $R_{27}$ and $R_{28}$ represent a hydrogen atom, alkyl group or an aryl group; $R_{29}$ to $R_{33}$ may be the same or different and represent a hydrogen atom, a halogen atom, an unsubstituted alkyl group, a substituted alkyl group, an unsubstituted aryl group or a substituted aryl group; b represents an integer from 1 to 30; and n represents an integer from 1 to 500.

The reason why a polycarbonate or polyester polymer having a siloxane structure represented by Formula (5) at one of the ends or both ends is more preferable is not yet elucidated; however, it is considered as follows. When a polysiloxane site is present at an end of the polymer, the degree of freedom of the siloxane moiety increases and then the surface migration property of the polycarbonate or polyester polymer are enhanced. The polycarbonate or polyester polymer moves and concentrates locally to the outermost surface of a surface layer, and as a result, very high lubricity is shown.

Furthermore, the polycarbonate or polyester polymer has a longer siloxane chain, it acts to increases the lubricity more effectively.

When average values of structural repeat unit number, n and m in Formulas (4) and (5) are 10 or more, the polycarbonate or polyester polymer exhibits particularly high lubricity. When the constitutional ratio (by mass) of a siloxane structural unit to the total mass of a polycarbonate or polyester polymer which has a siloxane structure represented by Formula (4) or Formula (5) or siloxane structures represented by both Formulas (4) and (5) is 10.0% by mass or more to 60.0% by mass or less, the polycarbonate or polyester polymer exhibits higher surface migration property, thereby exhibiting lubricity to the maximum advantageously. When the constitutional ratio (by mass) of the siloxane structural unit is less than the numerical range, it may be difficult to obtain high lubricity unless the content of a polycarbonate or polyester polymer having a siloxane structure represented by Formula (4) or Formula (5) or siloxane structures represented by both Formulas (4) and (5) is increased. If the amount of polycarbonate or polyester polymer added to the surface layer is greatly increased, sufficient lubricity and durability cannot be obtained at the same time although the situation varies depending upon the service life of an electrophotographic photosensitive member and the depth (Rdv) of the depressed portions of the present invention. Conversely, when the constitutional ratio (by mass) of the siloxane structural unit is larger than the aforementioned numerical range, the compatibility of the polycarbonate or polyester polymer with other materials constituting the surface layer decreases. As a result, the transparency of the surface layer may decrease and exposure light is scattered to cause lack of the light quantity. Consequently, some troubles may arise including the deteriorated electrophotographic properties and degraded image quality of printed images.

The constitutional ratio (by mass) used herein refers to a ratio (% by mass) of a part constituted of a siloxane structural unit represented by general Formula (4) or (5), occupied in the total mass of a resin. The siloxane structural unit refers to a repeat unit of a Si—O bond and also includes a substituent directly bonded to Si.

Concerning a cleaning blade, in general, to the edge of the cleaning blade, inorganic particles such as fluorinated carbon, cerium oxide, titanium oxide or silica are applied in addition to a toner to increase lubricity with a photosensitive member, thereby preventing blade turn-up. However, the surface of a photosensitive member containing a polycarbonate or polyester polymer, which has a siloxane structure at one of the ends or both of the ends, has extremely high lubricity. Furthermore, by combining the photosensitive member with a surface layer having the depressed portions according to the present invention, excellently high lubricity can be maintained even if the photosensitive member is repeatedly used. Therefore, even if a lubricant is not applied to the cleaning blade, blade turn-up and blade chattering do not occur. Good cleaning performance can be obtained from the beginning even during repeated use for long time.

As the siloxane structure represented by the general Formula (4) or (5), mention may be made of those derived from, for example, polyalkylsiloxane, polyarylsiloxane or polyalkylarylsiloxane. More specifically, polydimethylsiloxane, polydiethylsiloxane, polydiphenylsiloxane or polymethylphenylsiloxane may be mentioned. These may be used in a combination of two or more types. As the length of the polysiloxane group which is represented by an average value of structural repeat unit number, m in Formula (4) or n in Formula (5), m or n is 1 to 500, and preferably, 10 to 100. To obtain sufficient lubricity of siloxane, the value of m or n is preferably larger to some extent. However, it is not practical that the value of m or n exceeds 500 since the reactivity of a monofunctional phenyl compound having an unsaturated group decreases.

The weight-average molecular weight (Mw) of a fluorine-containing compound or a silicon-containing compound can be obtained by a customary method. To describe more specifically, a sample is added to tetrahydrofuran (THF) and allowed to stand for several hours. Thereafter, the sample and tetrahydrofuran are mixed well while shaking (until a coalescence of the sample resin disappears) and allowed to stand still further for 12 hours or more.

Thereafter, the resultant mixture is allowed to pass through a sample treatment filter (pore size: 0.45 to 0.5 μm, for example, My Shori Disk H-25-5 manufactured by Tosoh Corporation may be used) to obtain a sample for GPC (gel permeation chromatography). The concentration of the sample is adjusted to 0.5 to 5 mg/ml.

The sample thus obtained is subjected to the following measurement. A column is stabilized in a heat chamber of 40° C. Then, tetrahydrofuran serving a solvent is fed through the column maintained at this temperature at a flow rate of 1 ml/min. The GPC sample (10 μl) is injected to the column to measure a weight-average molecular weight (Mw). In order to measure the weight-average molecular weight (Mw) of the sample, the molecular weight distribution of the sample is calculated from the relationship between the logarithmic value of a calibration curve prepared using several kinds of monodisperse polystyrene standard samples and the count number. As the standard polystyrene sample for use in preparing the calibration curve, about 10 monodisperse polystyrene samples and having a molecular weight of 800 to 2,000,000 manufactured by Aldrich are suitably used. As a detector, an RI (refractive index) detector is used.

As the column, a plurality of commercially available polystyrene columns may be used in combination. For example, columns manufactured by Tosoh Corporation such as TSK gel G1000H($H_{XL}$), G2000H($H_{XL}$), G3000H($H_{XL}$), G4000H ($H_{XL}$), G5000H ($H_{XL}$), G6000H ($H_{XL}$), G7000H ($H_{XL}$) and TSK guard column, may be used in combination.

Next, typical examples of materials constituting a polycarbonate or polyester polymer, which has a structural repeat unit represented by Formula (4) and a structural repeat unit represented by Formula (2) or (3), and which has a structure represented by Formula (5) at one of the ends or both ends, will be described below. Synthesis examples using them will be described. However, the present invention is not limited to these.

First, examples of materials constituting a polymer having a structural unit represented by the general Formula (2) will be described.]

(2-1)

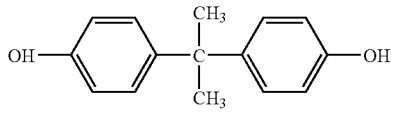

(2-2)

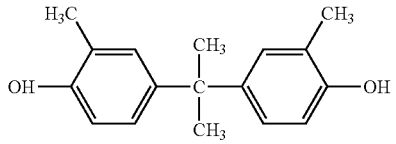

(2-3)

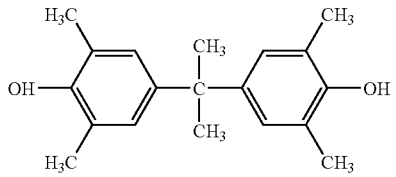

(2-4)

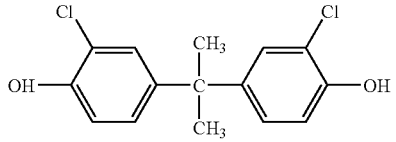

-continued
(2-5)
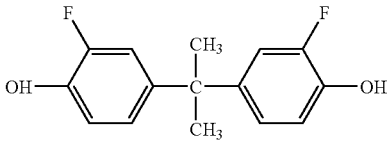
(2-6)
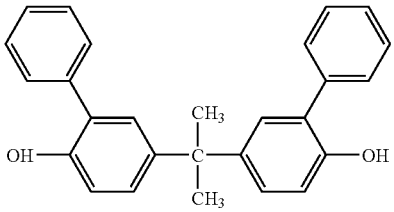
(2-7)
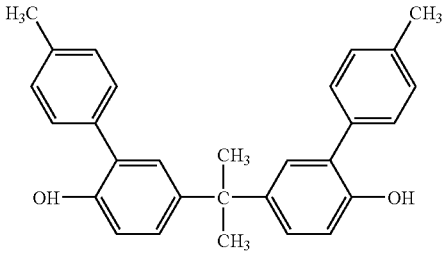
(2-8)
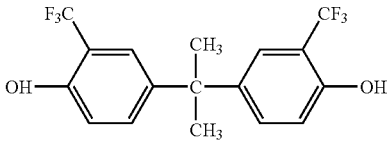
(2-9)
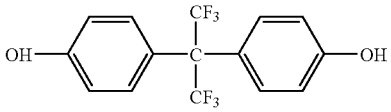
(2-10)
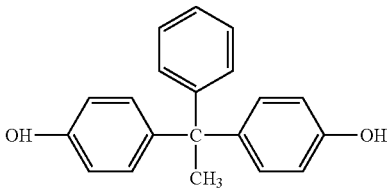
(2-11)
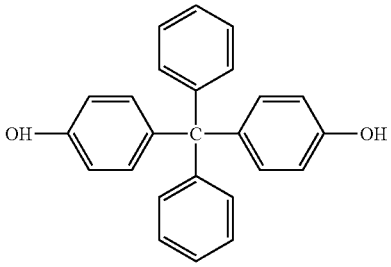
-continued
(2-12)
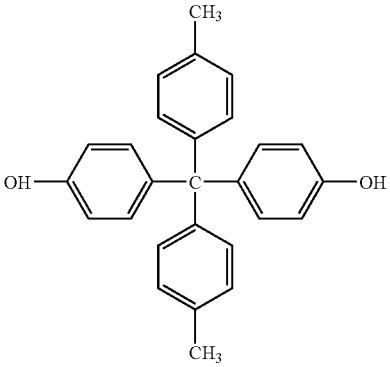
(2-13)
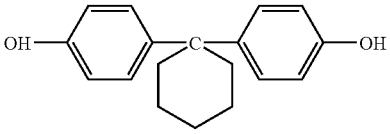
(2-14)
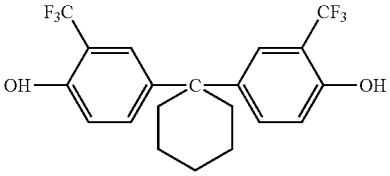
(2-15)
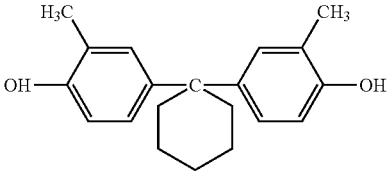
(2-16)
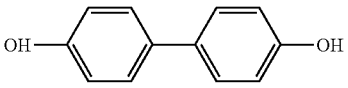
(2-17)
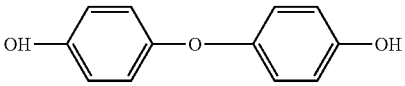
(2-18)
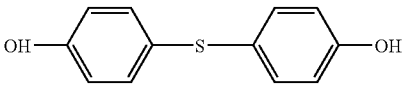
(2-19)
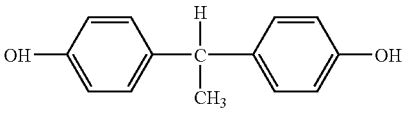

Of them, the structures represented by Formula (2-2) and (2-13) are preferable in view of film formability.

Next, examples of materials constituting a polymer having a siloxane structural unit represented by Formula (4) will be described (m represents an integer from 1 to 500 and is an average value of structural repeat unit number).

(4-1)

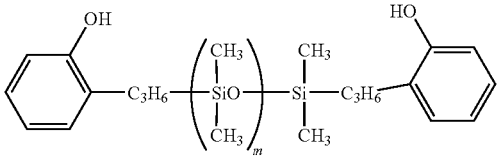

(4-2)

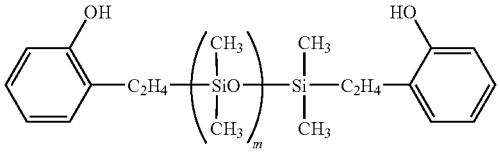

(4-3)

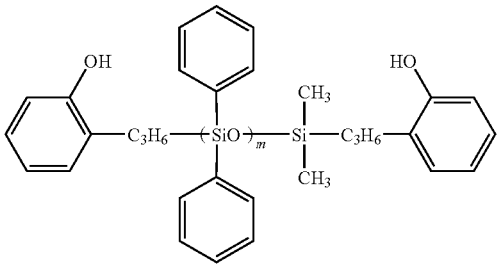

(4-4)

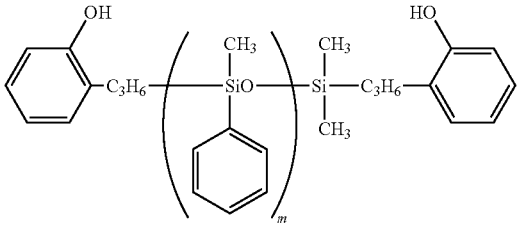

(4-5)

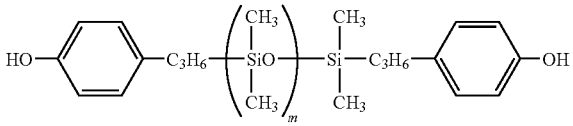

(4-6)

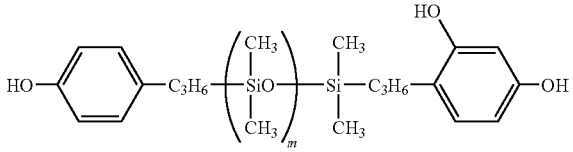

(4-7)

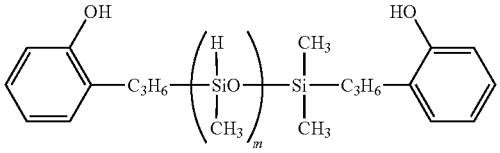

-continued (4-8)

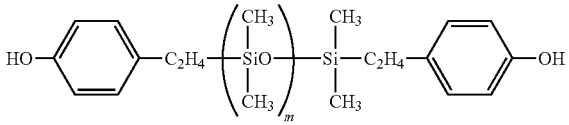

(4-9)

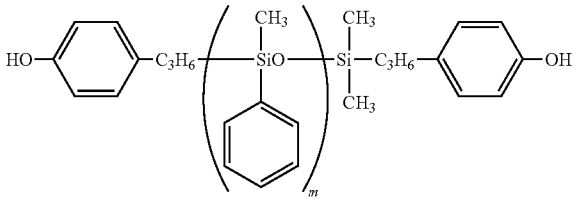

Next, examples of materials constituting a polymer having a siloxane structural unit represented by Formula (5) will be described (n represents an integer from 1 to 500 and is an average value of structural repeat unit number).

(5-1)

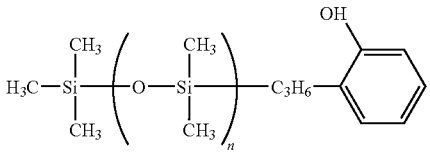

(5-2)

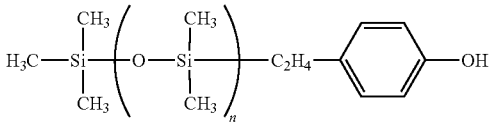

(5-3)

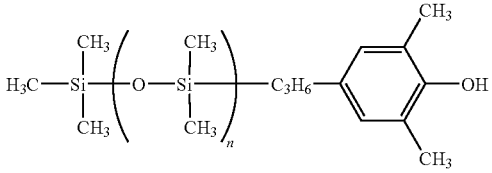

(5-4)

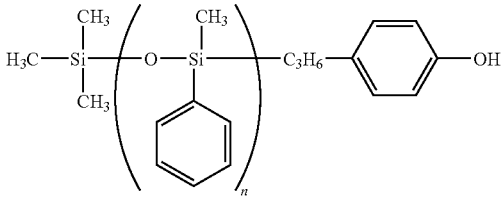

(5-5)

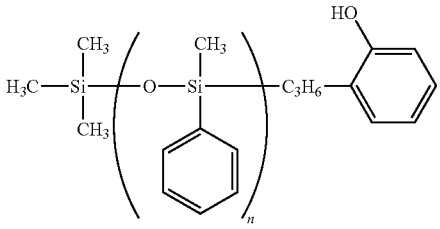

-continued (5-6)

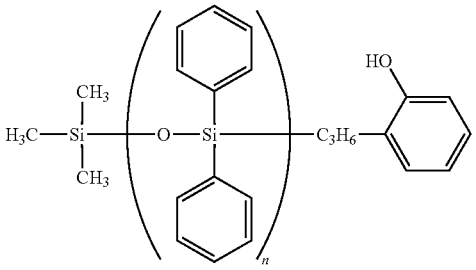

(5-7)

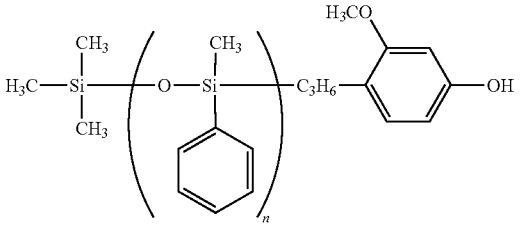

(5-8)

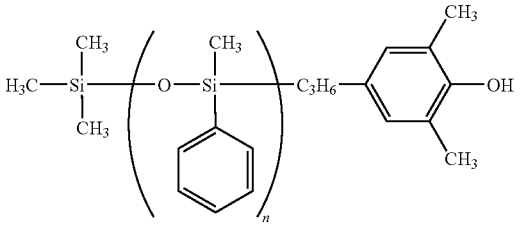

(5-9)

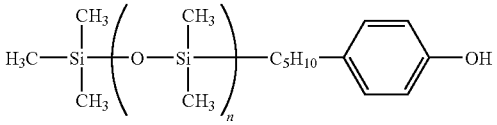

(5-10)

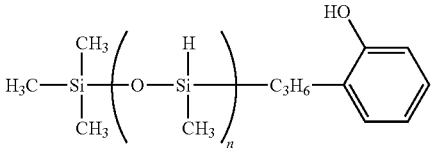

Synthesis examples of polycarbonate or a polyester polymer having a siloxane structure at one of the ends or both of the ends will be described below.

SYNTHESIS EXAMPLE 1

To 500 ml of a 10% aqueous sodium hydroxide solution, 120 g of bisphenol represented by (2-13) was added and dissolved. To the solution, ml of dichloromethane was added and stirred. While maintaining the temperature of the resultant solution at 10 to 15° C., 100 g of phosgene was blown into the solution for one hour. When about 70% of the phosgene was blown in, 10 g of a siloxane compound which is represented by (4-1) and has an average value of structural repeat unit number (m) of 20 and 20 g of a siloxane compound which is represented by (5-1) and has an average value of structural repeat unit number (n) of 20 were added to the solution. After completion of phosgene introduction, the reaction solution was vigorously stirred to emulsify it. To this, 0.2 ml of triethylamine was added and stirred for one hour. Thereafter, a dichloromethan phase was neutralized with phosphoric acid and repeatedly washed with water until the pH of the phase reached about 7. Subsequently, the liquid phase was added dropwise to isopropanol. The precipitate was filtrated and dried to obtain a white powdery polymer (a polycarbonate polymer having a siloxane structure at one of the ends or both of the ends).

The obtained polymer was analyzed by infrared (IR) absorption spectrum. There were absorption by a carbonyl group at 1750 $cm^{-1}$ and absorption by an ether bond at 1240 $cm^{-1}$. Thus, the presence of a carbonate bond was confirmed. Substantially no absorption was observed at 3650 to 3200 $cm^{-1}$. Thus, the presence of a hydroxyl group was not confirmed. The amount of residual phenolic OH measured by absorptiometry was 112 ppm. Furthermore, a peak derived from siloxane was observed at 1100 to 1000 $cm^{-1}$. The polycarbonate polymer of the present invention was subjected to $^{1}$H-NMR measurement. The peak-area ratio of a hydrogen atom constituting a resin was converted to obtain a copolymerization ratio. As a result, it was confirmed that the ratio of the siloxane moiety formed from Formula (4-1) to the siloxane moiety formed from Formula (5-1) was about 1:2, and that the ratio of average values of structural repeat unit number, m:n was approximately 20:20. Furthermore, the viscosity average molecular weight (Mv) was about 26,000. The limiting viscosity at 20° C. was 0.46 dl/g. The constitutional ratio of the siloxane moiety by mass was about 20.0%.

This polycarbonate polymer has a polysiloxane moiety at both ends of the polycarbonate resin. In addition, a siloxane moiety is polymerized with the main chain of the polycarbonate resin. Note that the viscosity average molecular weight (Mv) is measured as follows. The aforementioned polycarbonate or polyester polymer having a siloxane structure at one of the ends or both of the ends is dissolved in a dichloromethane solution so as to be in a concentration of 0.5 w/v %. The limiting viscosity of the solution at 20° C. is measured. A viscosity-average molecular weight (Mv) was obtained with $1.23\times10^{4}$ and 0.83 assumed as K and a of the Mark-Houwink-Sakurada formula, respectively.

SYNTHESIS EXAMPLE 2

Synthesis was performed in the same manner as in Synthetic Example 1 except that 25 g of a siloxane compound which is represented by Formula (4-1) and has an average value of structural repeat unit number (m) of 40 and 55 g of a siloxane compound which is represented by Formula (5-1) and has an average value of structural repeat unit number (n) of 40 were used. In this manner, a polycarbonate polymer to be used in the present invention was obtained. The viscosity average molecular weight (Mv) was about 20,600. The ratio of average values of structural repeat unit number of the polycarbonate polymer, m:n was about 40:40. The constitutional ratio (by mass) of the siloxane moiety was about 40.0%, and the polycarbonate resin has a structure in which polysiloxane moieties are present at both ends thereof and a siloxane moiety was also polymerized to the main chain of the polycarbonate resin. The facts were confirmed by infrared absorption spectrum and 1H-NMR. The amount of residual phenolic OH obtained by absorptiometry was 175 ppm.

SYNTHESIS EXAMPLE 3

In a reaction container equipped with a stirrer, 90 g of bisphenol represented by Formula (2-2), 0.82 g of p-tert-butylphenol, 33.9 of sodium hydroxide and 0.82 g of tri-n-butylbenzylammonium chloride serving as a polymerization catalyst were placed and dissolved in 2,720 ml of water (water phase). To 500 ml of methylene chloride, 4 g of a siloxane compound (average value of structural repeat unit number m=40) represented by Formula (4-1) and 8 g of a siloxane compound (average value of structural repeat unit number n=40) represented by Formula (5-1) were dissolved (organic phase 1). Separately, to 1,500 ml of methylene chloride, 74.8 of a terephthalic acid chloride/isophthalic acid chloride (1:1) mixture was added and dissolved (organic phase 2). First, organic phase 1 was added to the water phase previously prepared while vigorously stirring. Next, organic phase 2 was added and a polymerization reaction was performed at 20° C. for 3 hours. Thereafter, 15 ml of acetic acid was added to terminate the reaction. The water phase was separated from the organic phase by decantation. The organic phase was washed with water and separated by a centrifuge. This operation was repeatedly performed. The total amount of water used in washing was 50 fold as large as the mass of the organic phase. After that, the organic phase was added to methanol to allow a polymer to precipitate. The polymer was separated and dried to obtain a polyester polymer having a siloxane structure at one of the ends or both of the ends.

The viscosity average molecular weight (Mv) of the aforementioned polycarbonate or polyester polymer having a siloxane structure at one of the ends or both ends is preferably 5,000 to 200,000, and particularly preferably, 10,000 to 100,000. In synthesis, in order to control the molecular weight, in addition to a monofunctional siloxane compound, another monofunctional compound may be added as an end terminator. Examples of such a terminator include compounds usually used for producing a polycarbonate, such as phenol, p-cumyl phenol, p-t-butylphenol, benzoic acid and benzyl chloride.

The residual moisture content in the polycarbonate or polyester polymer having a siloxane structure at one of the ends or both ends is preferably 0.25 wt % or less. The residual solvent amount is preferably 300 ppm or less and the residual salt amount is preferably 2.0 ppm or less in view of electrophotographic property. In addition, the polycarbonate polymer to be used in the present invention has preferably a limiting viscosity at 20° C. of preferably less than 10.0 dl/g and more preferably 0.1 to 1.5 dl/g in a 0.5 g/dl solution thereof in dichloromethane as a solvent.

Furthermore, the amount of residual phenolic OH determined by absorptiometry is preferably 500 ppm or less, and more preferably, 300 ppm or less.

The moisture content herein is obtained by a Karl Fischer moisturizer. More specifically, the moisture content concentration was obtained by dissolving the polycarbonate or polyester polymer having a siloxane structure at one of the ends or both ends in dichloromethane and subjecting the solution to automatic measurement using a Karl Fischer reagent and a standard methanol reagent. The residual solvent amount in the polymer can be quantitatively determined by dissolving the polycarbonate polymer according to the present invention in dioxane and subjecting the solution to gas chromatography. In this way, the residual solvent amount can be directly quantified. As to the residual salt amount, the concentration of salt can be determined based on the amount of chlorine measured by a potential difference measuring apparatus.

When the aforementioned polycarbonate or polyester polymer having a siloxane structure at one of the ends or both ends is localized near the surface of a surface layer, even in a small amount, excellent lubricity and strength can be obtained; however, the polycarbonate or polyester polymer is preferably used in combination with a resin having more excellent strength. The mixing ratio of the polycarbonate or polyester polymer having a siloxane structure at one of the ends or both ends to the resin is preferably 0.5 parts by mass to 1 to 99 parts by mass. Since the polycarbonate or polyester polymer having a siloxane structure at one of the ends or both ends tends to localize near the surface of a photosensitive layer, even if it is contained in a low blend ratio, high lubricity is exhibited. When the polycarbonate or polyester polymer is employed simultaneously with the surface shape of the present invention, excellent smoothness can be persistently obtained and good cleaning performance can be obtained even if the photosensitive layer is repeatedly used for a long time. In addition, a solution of the polycarbonate or polyester polymer having a siloxane structure at one of the ends or both ends is excellent in transparency. Therefore, the solution provides good electrophotographic properties even if the photosensitive member is repeatedly used for a long time and is suitably applied to a photosensitive member. For example, to 20.0 g of a solvent mixture of chlorobenzenre/dimethoxymethane (1:1 by mass), 4.0 g of the polycarbonate polymer shown in Synthetic Example 2 is added and stirred overnight or more.

After the polymer is completely dissolved, the solution is transferred to a cell of 1-cm squares and subjected to UV spectrometry. When the transmissivity of the solution is measured at 778 nm, it is 99% as high as that of a blank consisting of the solvent alone.

Furthermore, the aforementioned polycarbonate or polyester polymer is preferably used in combination with silicone oil (preferably dimethylsilicone oil) represented by Formula (6) below and a small amount of modified silicone oil because excellent smoothness is achieved and deterioration of properties is very little. Silicone oils may be used singly or in a mixture of two or more types.

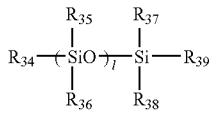

(6)

where, $R_{34}$ to $R_{39}$ may be the same or different and represent a hydrogen atom, a halogen atom, an unsubstituted alkyl group, a substituted alkyl group, an unsubstituted aryl group or a substituted aryl group; and l represents an average value of structural repeat unit number.

Note that when synthesis is performed by using a monofunctional siloxane compound (a compound (5-1) in Synthesis Examples 1, 2 and 3,) alone without adding bifunctional siloxane compound (a compound (4-1) in Synthesis Examples 1, 2 and 3), a polycarbonate polymer having no siloxane structure in the main chain and having a siloxane structure at one of the ends or both ends of the polycarbonate repeat units can be synthesized. This polycarbonate polymer may be used in combination with a polycarbonate of the present invention which has a siloxane structure both in the main chain and end.

Next, the structure of an electrophotographic photosensitive member according to the present invention will be described.

As is described above, the electrophotographic photosensitive member of the present invention has a support and an organic photosensitive layer (hereinafter sometimes simply referred to as "photosensitive layer") formed on the support. As the electrophotographic photosensitive member of the present invention, generally a cylindrical organic electrophotographic photosensitive member having a photosensitive layer formed on a cylindrical support is widely used. However, another form such as belt-like form or sheet-like form may be employed.

The photosensitive layer may be a single layer photosensitive layer simultaneously containing a charge transport substance and a charge generation substance in the same layer, or may be a laminate type (functionally separated) photosensitive layer formed of separate layers: a charge generation layer containing a charge generation substance and a charge transport layer containing a charge transport substance. As an electrophotographic photosensitive member according to the present invention, a laminate type photosensitive member is preferable in view of electrophotographic property. The laminate type photosensitive member may be a regular-layer type photosensitive layer in which a charge generation layer and a charge transport layer are laminated in this order on a support, or may be a reverse-layer type photosensitive layer in which a charge transport layer and a charge generation layer are laminated in this order on a support. When a laminated type photosensitive layer is employed as an electrophotographic photosensitive member according to the present invention, the regular-layer type photosensitive layer is preferable in view of electrophotographic property. Furthermore, the charge generation layer may have a laminate structure, and the charge transport layer may have a laminate structure. Moreover, a protection layer may be provided on the photosensitive layer to improve the durability performance.

As the support of the electrophotographic photosensitive member, a support having electroconductivity (conductive support) is preferable. For example, a support formed of a metal such as aluminum, an aluminum alloy or stainless steel may be used. In the case of aluminum or an aluminum alloy, an ED pipe, an EI pipe and those obtained by subjecting these pipes to cutting, electrolytic composite polishing (electrolysis carried out using an electrode having electrolytic action and an electrolytic solution, and polishing carried out using a grinding stone having polishing action) or to wet-process or dry-process honing. Furthermore, the above metal support and a resin support (polyethylene terephthalate, polybutylene terephthalate, a phenolic resin, polypropylene or a polystyrene resin), having a layer film-formed by vacuum evaporation of aluminum, an aluminum alloy or an indium oxide-tin oxide alloy. Furthermore, the support may be formed of a resin or paper impregnated with electroconductive particles such as carbon black particles, tin oxide particles, titanium oxide particles or silver particles or may be formed of a plastic having a conductive binder resin.

For the purpose of prevention of interference fringes caused by scattering of laser light or the like, the surface of the support may be subjected to cutting, surface roughening or aluminum anodizing.

The support may preferably have, where the surface of the support is a layer provided in order to impart conductivity, such a layer may have, a volume resistivity of $1\times10^{10}\Omega\cdot$cm or less, and, in particular, more preferably $1\times10^{6}\Omega\cdot$cm or less.

A conductive layer may be formed between the support and an intermediate layer (described later) or a photosensitive layer (charge generation layer or charge transport layer) in order to prevent interference fringe caused by scattering of laser light or to cover scars of the support. The conductive layer can be formed by applying a coating solution having particles of conductive powder dispersed in an appropriate binder resin.

Examples of the conductive powder include carbon black, acetylene black; a metal powder such as aluminum, nickel, iron, nichrome, copper, zinc or silver; and a metal oxide powder such as conductive tin oxide or ITO.

Examples of the binder resin to be used in combination include a thermoplastic resin, a thermosetting resin and photo-setting resin such as polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, a polyarylate resin, a phenoxy resin, polycarbonate, a cellulose acetate resin, an ethyl cellulose resin, polyvinylbutyral, polyvinylformal, polyvinyltoluene, poly-N-vinyl carbazole, an acrylic resin, a silicone resin, an epoxy resin, a melamine resin, an urethane resin, a phenol resin and an alkyd resin.

The conductive layer can be formed by dispersing or dissolving a conductive powder as mentioned above and a binder resin in an ether solvent such as tetrahydrofuran or ethylene glycol dimethylether; an alcohol solvent such as methanol; a ketone solvent such as methylethylketone; or an aromatic hydrocarbon solvent such as toluene and applying the solution. An average film-thickness of the conductive layer is preferably 0.2 μm or more to 40 μm or less, more preferably, 1 μm or more to 35 μm or less, and more preferably, 5 μm or more to 30 μm or less.

An intermediate layer having a barrier function and an adhesive function may be provided between the support or the conductive layer and the photosensitive layer (charge generation layer or charge transport layer). The intermediate layer is formed to improve adhesiveness of the photosensitive layer, coating property and charge injection from the support and to protect against electric breakage of a photosensitive layer.

The intermediate layer is formed by applying a curable resin and curing the resin to form a resin layer or by applying an intermediate layer coating solution containing a binder resin onto a conductive layer and drying it.

Examples of the binder resin contained in the intermediate layer include a water-soluble resins such as polyvinyl alcohol, polyvinyl methyl ether, polyacrylic acid, methylcellulose, ethylcellulose, polyglutamic acid or casein; a polyamide resin, a polyimide resin, a polyamide-imide resin, a polyamide acid resin, a melamine resin, an epoxy resin, a polyurethane resin and polyglutamic ester resin. To effectively obtain electric barrier property, a thermoplastic resin is preferably used as the binder resin to be used as the intermediate layer in view of coating property, adhesiveness, solvent resistance and electric resistance. More specifically, a thermoplastic polyamide resin is preferable. As the polyamide resin, a low crystalline or amorphous copolymer nylon is preferable which can be applied in a molten state. An average film-thickness of the intermediate layer is 0.05 μm or more to 7 μm or less, more preferably, 0.1 μm or more to 2 μm or less.

In order to prevent stagnation of charge (carrier) flow in the intermediate layer, semiconductor particles may be dispersed in the intermediate layer or an electron transport substance (electron accepting substance such as an acceptor) may be contained in the intermediate layer.

Next, a photosensitive layer according to the present invention will be described.

Examples of the charge generation substance to be used in an electrophotographic photosensitive member according to the present invention include an azo pigment such as monoazo, disazo or trisazo pigment; a phthalocyanine pigment such as metal phthalocyanine or metal-free phthalocyanine; an indigo pigment such as indigo or thioindigo; a perylene pigment such as perylene acid anhydride or a perylene acid imide, a polycyclic quinone pigment such as anthraquinone or pyrenequinone, a squarylium dye, a pyrylium salt or a thiapyrylium salt, triphenylmethane coloring matter; an inorganic substance such as selenium, selenium-tellurium or amorphous silicon; a quinacridone pigment, an azulenium salt pigment, a cyanine dye, a xanthene coloring matter, a quinone-imine coloring matter and a styryl coloring matter.

These charge generation materials may be used singly or in a combination with two or more types. Of them, metal phthalocyanine such as oxytitaniumphthalocyanine, hydroxygalliumphthalocyanine or chlorogalliumphthalocyanine is preferable since it has high sensitivity.

In the case where the photosensitive layer is a laminate-type photosensitive layer, examples of the binder resin to be used in the charge generation layer include a polycarbonate resin, a polyester resin, a polyarylate resin, a butyral resin, a polystyrene resin, a polyvinylacetal resin, a diallylphthalate resin, an acrylic resin, a methacrylic resin, a vinyl acetate resin, a phenolic resin, a silicone resin, a polysulfone resin, styrene-butadiene copolymer resin, an alkyd resin, an epoxy resin, a urea resin and a vinyl chloride-vinyl acetate copolymer resin. In particular, a butyral resin is preferable. These may be used singly or in combination, alternatively as a copolymer singly or in combination of two or more types.

The charge generation layer is formed by applying a charge generation layer coating solution, which is obtained by dispersing a charge generation substance in a binder resin and a solvent, followed by drying. The charge generation layer may be formed as a deposition film of a charge generation substance. As a dispersion method, mention may be made of a method using a homogenizer, ultrasonic wave, a ball mill, a sand mill, an attritor or a roll mill. The ratio of the charge generation substance to the binder resin preferably falls within the range of 10:1 to 1:10 (by mass), and particularly preferably, 3:1 to 1:1 (by mass).

The solvent to be used in the charge generation layer coating solution is selected based on the solubility and dispersion stability of the binder resin and charge generation substance to be used. Examples of an organic solvent include an alcohol solvent, a sulfoxide solvent, a ketone solvent, an ether solvent, an ester solvent and an aromatic hydrocarbon solvent.

The average film thickness of the charge generation layer is preferably 5 μm or less, and particularly preferably, 0.1 μm or more to 2 μm or less.

Furthermore, various additives such as a sensitizer, an antioxidant, an UV absorber and/or a plasticizer may be optionally added to the charge generation layer. To prevent stagnation of charge (carrier) flow in the charge generation layer, the charge generation layer may contain an electron transport substance (electron accepting substance such as an acceptor).

In the case of a laminate-type photosensitive member, a charge transport layer is formed on the charge generation layer. The charge transport layer contains a charge transport substance. Examples of the charge transport substance include a triarylamine compound, a hydrazone compound, a styryl compound, a stilbene compound, a pyrazoline compound, an oxazole compound, a thiazole compound and a triarylmethane compound.

These charge transport substances may be used singly or in a combination of two or more types. In the present invention, when a charge transport layer is a surface layer, silicon- or fluorine-containing polymer at least soluble in a coating solvent is contained. These may be used singly or in a combination of two or more. Furthermore, the charge transport layer may be formed by optionally blending another binder resin and dissolving the mixture in an appropriately solvent, followed by drying. When drying is performed at a temperature of 100° C. or more, a silicon- or a fluorine-containing compound is likely to migrate to the outermost surface of the surface layer, although migration property varies depending upon the structure of the compound. As a result, higher lubricity can be maintained for a long time. Thus, the aforementioned drying temperature is also preferable in view of long-lasting effect.

Examples of the binder resin to be blended with a silicon-containing compound or a fluorine-containing compound according to the present invention include an acrylic resin, an acrylonitrile resin, an allyl resin, an alkyd resin, an epoxy resin, a silicone resin, nylon, a phenolic resin, a phenoxy resin, a butyral resin, a polyacrylamide resin, a polyacetal resin, a polyamide-imide resin, a polyamide resin, a polyarylether resin, a polyarylate resin, a polyimide resin, a polyurethane resin, a polyester resin, a polyethylene resin, a polycarbonate resin, a polystyrene resin, a polysulfone resin, a polyvinylbutyral resin, a polyphenylene oxide resin, a polybutadiene resin, a polypropylene resin, a methacrylic resin, a urea resin, a vinyl chloride resin and a vinyl acetate resin. In particular, a polyarylate resin and a polycarbonate resin are preferable in view of compatibility with a solvent, electrophotographic property, long-lasting effect obtained by migration toward a surface in combination with a shape of the surface when a modified polycarbonate with a silicon- or fluorine compound and a polyester are used. These may be used singly or in a mixture of two or more types.

The ratio of the charge transport substance to the binder rein preferably falls within the range of 2:1 to 1:2 (by mass).

The film thickness of the charge transport layer is preferably from 5 to 50 μm, and particularly preferably, 7 to 30 μm.

The charge transport layer may contain additives such as an antioxidant, an UV absorber and a plasticizer.

When the photosensitive layer is formed of a single layer, the photosensitive layer may be formed by dispersing a charge generation material and a charge transport material as mentioned above in a binder resin as mentioned above and dissolving the dispersed resin in a solvent, applying the solution and drying.

The coating solution for each layer may be applied by a coating method such as a dip-coating method, a spray-coating method, a spinner-coating method, a roller-coating method, a Mayer bar coating method and a blade-coating method.

The viscosity of a coating liquid is preferably 5 mPa·s or more to 500 mPa·s or less in view of coating property.

Examples of the solvent to be used in a charge transport layer coating solution include a ketone solvent such as acetone or methylethyl ketone; an ester solvent such as methyl acetate or ethyl acetate; an ether solvent such as tetrahydrofuran, dioxolane, dimethoxymethane or dimethoxyethane; and an aromatic hydrocarbon solvent such as toluene, xylene or chlorobenzene. These solvents may be used singly or in a mixture of two or more types. Of these solvents, an ether solvent or an aromatic hydrocarbon solvent is preferably in view of resin solubility.

The average film-thickness of the charge transport layer is preferably from 5 to 50 μm, and particularly preferably, 10 to 35 μm.

Furthermore, the charge transport layer may optionally contain additives such as an antioxidant, an UV absorber and/or a plasticizer.

In the present invention, in the case where further improvement of durability is required, a second charge transport layer or a protecting layer may be formed on the charge transport layer. In this case, the second charge transport layer or protecting layer must be formed on the surface such that the layer contains at least a silicon-containing compound or a fluorine-containing compound soluble in a coating solution and has depressed portions satisfying a ratio (Rdv/Rpc), which is a ratio of the depth to the major axis diameter, of from more than 0.3 to 7.0 or less.

The second charge transport layer or protecting layer may be formed of a charge transport substance having plasticity and a binder resin, as is in the case of the charge transport layer. To provide higher durability, it is effective to use a hardening resin to form the surface layer.

To form the surface layer of a hardening resin, the charge transport layer may be formed of a hardening resin. Furthermore, a hardening resin layer may be formed, as the second transport layer or protecting layer, on the charge transport layer. The hardening resin layer must satisfy both properties: ensuring the strength of a film and charge transporting ability. The hardening resin layer is generally constituted of a charge transport material and a polymerizable or crosslinkable monomer or oligomer.

In the method of forming these surface layers of a hardening resin, a known hole-transporting compound and electron-transporting compound may be used as a charge-transporting material. As the materials for use in synthesis of these compounds, materials having an acryloyloxy group or a styrene group for use in chain polymerization may be mentioned. In addition, materials having a hydroxyl group, an alkoxysilyl group or an isocyanate group for use in stepwise polymerization may be mentioned. Particularly, in view of electrophotographic property, versatility, material design and production stability of an electrophotographic photosensitive member having a surface layer formed of a hardening resin, a hole-transporting compound is preferably used in combination with materials for use in chain polymerization. Furthermore, an electrophotographic photosensitive member particularly preferably has a surface layer which is formed by hardening a compound having both a hole-transporting group and an acryloyloxy group within a molecule.

As a hardening means, a known means such as heat, light or radiation may be used.

The average film thickness of the hardened layer is preferably 5 μm or more to 50 μm or less, and more preferably, 10 μm or more to 35 μm or less for a charge transport layer. In the case of the second charge transport layer or protecting layer, the average film thickness is preferably 0.3 μm or more to 20 μm or less, and more preferably, 1 μm or more to 10 μm or less.

Various additives may be added to each of the layers of an electrophotographic photosensitive member according to the present invention. Examples of additives include deterioration-preventing agents such as an antioxidant and UV absorber.

Next, a process cartridge and electrophotographic apparatus according to the present invention will be described. A process cartridge according to the present invention has the electrophotographic photosensitive member and at least one means selected from the group consisting of a charging means, a developing means, a transfer means and a cleaning means. The electrophotographic photosensitive member and the means are integrally supported. The cartridge can be detachably attached to an electrophotographic apparatus main body. An electrophotographic apparatus according to the present invention has the electrophotographic photosensitive member, a charging means, an exposure means, a developing means and a transfer means.

Figure 10:
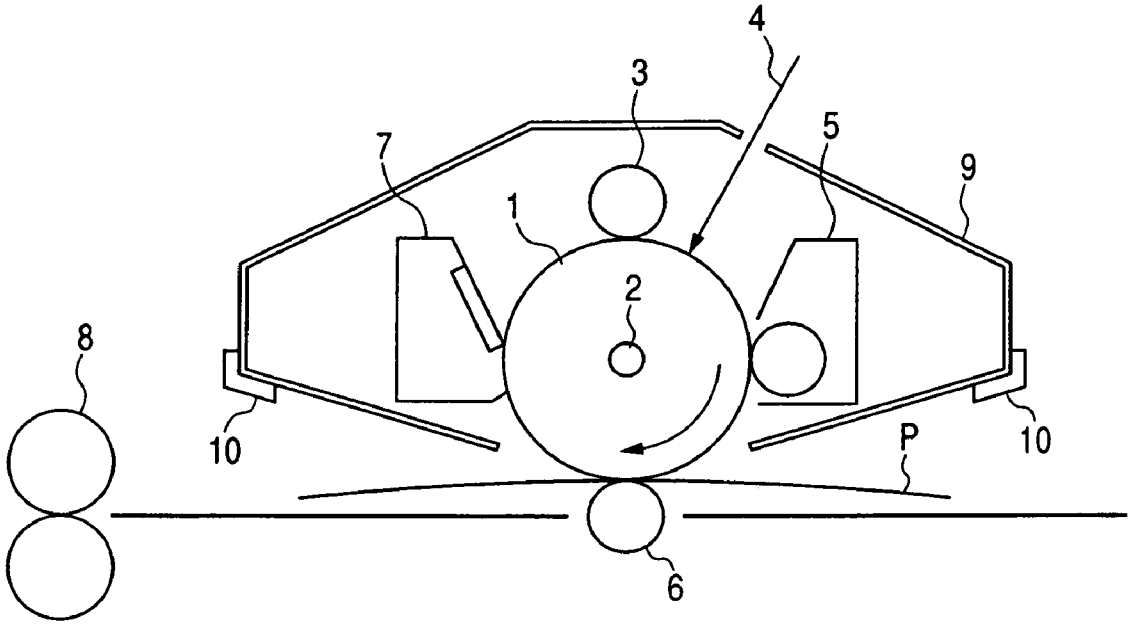
FIG. 10 is a schematic view illustrating a structure of an electrophotographic apparatus equipped with a process cartridge having an electrophotographic photosensitive member according to the present invention.

FIG. 10 is a schematic view illustrating the structure of an electrophotographic apparatus equipped with a process cartridge having an electrophotographic photosensitive member according to the present invention. In FIG. 10, reference numeral 1 indicates a cylindrical electrophotographic photosensitive member, which is rotated at a predetermined circumferential speed about an axis 2 in the direction indicated by the arrow.

The surface of the electrophotographic photosensitive member 1 in rotation is uniformly charged positively or negatively at a predetermined potential by a charging means 3 (primary charging means such as a charging roller), and subsequently, irradiated with exposure light (image-forming exposure light) 4 emitted from an exposure means (not shown) such as slit exposure or a laser beam scanning exposure. In this manner, latent images corresponding to a desired image are successively formed on the surface of the electrophotographic photosensitive member 1.

The latent images formed on the surface of the electrophotographic photosensitive member 1 are developed with a toner contained in a developer in a developing means 5 into toner images. Subsequently, the toner images thus formed and carried on the surface of the electrophotographic photosensitive member 1 are successively transferred to a transfer material (e.g., paper) P, which is fed between the electrophotographic photosensitive member 1 and a transfer means 6 (contact portion) from a transfer-material supply means (not shown) in synchronisms with the rotation of the electrophotographic photosensitive member 1, by means of transfer bias supplied from the transfer means (e.g., transfer roller) 6.

The transfer material P onto which the toner images are transferred is separated from the surface of the electrophotographic photosensitive member 1 and introduced into a fixing means 8, in which the images are fixed. In this manner, an image-formed material (printed matter or copy) is discharged out of the apparatus as a printed matter.

After the toner images are transferred, the surface of the electrophotographic photosensitive member 1 is cleaned by a cleaning means (such as a cleaning blade) 7 to remove the developer (toner) remaining after the transfer. Recent years, in order to remove a polymerization toner having a smaller particle size, a liner pressure of 300 to 1,200 mN/cm is usually required where the force to be applied to a unit length, in the longitudinal direction, of the contact portion between a photosensitive member and a cleaning blade is assumed as a contact linear pressure. Even when such a high linear pressure is applied, if the electrophotographic photosensitive member of the present invention is employed, blade turn-up does not occur and good cleaning performance can be achieved even if it is used repeatedly for a long period of time. In this way, the effect of the present invention can be effectively exerted.

Furthermore, the surface of the electrophotographic photosensitive member 1 is subjected to charge removal making use of pre-exposure light (not shown) from a pre-exposure means (not shown) and repeatedly used for image formation. Note that, as shown in FIG. 10, when the charging means 3 is for example a contact-type charging unit using a charging roller, the pre-exposure is not always required.

Of the structural means of electrophotographic photosensitive member 1, charging means 3, developing means 5 and cleaning means 7, a plurality of the components may be integrally joined in a container to form a process cartridge. The process cartridge may be designed so as to be detachably attached to an electrophotographic apparatus main body such as a copier or a laser-beam printer. In FIG. 10, the electrophotographic photosensitive member 1, charging means 3, developing means 5 and cleaning means 7 are integrally supported in the form of cartridge, which is used as a process cartridge 9 detachably attached to an electrophotographic apparatus main body with the help of a guide means 10, such as rails, of an electrophotographic apparatus main body.

EXAMPLES

The present invention will be more specifically described by way of examples, below. Note that the term "part(s)" in the examples means "parts by mass".

Example 1

An aluminum cylinder of 30 mm in diameter and 257 mm in length was used as a support (cylindrical support).

Next, a solution containing the following components was dispersed by a ball mill for about 20 hours to prepare a conductive-layer coating.

| | |
|---|---|
| Powder formed of barium sulfate having a coating layer of tin oxide (Trade name: Pastran PC1 manufactured by Mitsui Mining & Smelting Co., Ltd.) | 60 parts |
| Titanium oxide (Trade name: TITANIX JR manufactured by Tayca Corporation) | 15 parts |
| Resole type phenolic resin (Trade name: Phenolite J-325 (solid matter: 70%) manufactured by Dainippon Ink & Chemicals Incorporated) | 43 parts |
| Silicone oil (Trade name: SH28PA, manufactured by Toray Silicone Co., Ltd.) | 0.015 parts |
| Silicone resin (Trade name: Tospal 120, manufactured by Toshiba Silicone) | 3.6 parts |
| 2-methoxy-1-propanol | 50 parts |
| Methanol | 50 parts |

The conductive-layer coating prepared by the method above was applied onto the aforementioned support in a dip method. The support was thermally hardened for one hour in an oven heated to 140° C.

In this manner, a conductive layer having an average film thickness of 15 μm which was measured at a distance of 130 mm from the top end of the support.

Next, an intermediate-layer coating was prepared by dissolving the following components in a solvent mixture of methanol (400 parts)/n-butanol (200 parts) and applied onto the conductive layer above by dipping, and the coating was dried with heating in an oven heated to 100° C. for 30 minutes to obtain an intermediate layer having an average film-thickness of 0.65 μm which was measured at a distance of 130 mm from the top end of the support.

| | |
|---|---|
| Copolymer Nylon resin (Trade name: Amilan CM 8000 manufactured by Toray Industries, Inc.) | 10 parts |
| Methoxymethylated 6 nylon resin (Trade name: Toresin EF-30T, manufactured by Teikoku Chemical Industries Co., Ltd.) | 30 parts |

Next, the following components were dispersed by a sand-mill unit using glass beads of 1 mm in diameter for 4 hours. Thereafter, 700 parts of ethyl acetate was added to prepare a charge-generation layer coating.

| | |
|---|---|
| Hydroxygalliumphthalocyanine (having a strong diffraction peak at 7.5°, 9.9°, 16.3°, 18.6°, 25.1°, 28.3° (Bragg angles (2θ ± 0.2°) in CuKα X-ray diffraction) | 20 parts |
| Calixarene compound represented by the following structural Formula (7) | 0.2 parts |

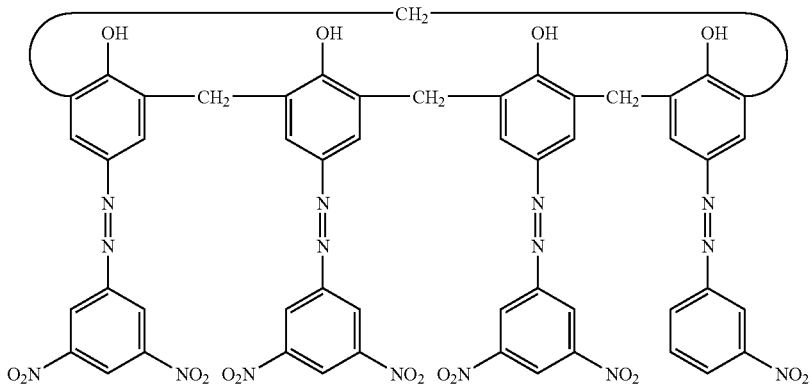

(7)

| | |
|---|---|
| Polyvinylbutyral (Trade name: S-REC BX-1 manufactured by Sekisui Chemical Co., Ltd.) | 10 parts |
| Cyclohexanone | 600 parts |

The charge-generation layer coating was applied onto the intermediate layer by a dip coating method and dried with heat in an oven heated to 100° C. for 10 minutes to from a charge generation layer having an average film-thickness of 0.17 μm, which was measured at a distance of 130 mm from the top end of the support.

Subsequently, the following components were dissolved in a solvent mixture containing chlorobenzene (350 parts) and dimethoxymethane (150 parts) to prepare a charge-transport layer coating. Using this, a charge transport layer was formed by dip coating on the charge generation layer and dried with heat in an oven heated to 110° C. for 30 minutes to form a charge transport layer having an average film-thickness of 20 μm, which was measured at a distance of 130 mm from the top end of the support.

where m and n represent a ratio (copolymerization ratio) of repeat units in the resin; m:n=7:3 for the resin.

Note that a molar ratio of terephthalic acid structure to isophthalic acid structure in the polyacrylate resin, (a molar ratio of terephthalic acid skeleton: isophthalic acid skeleton) is 50:50. The weight-average molecular weight (Mw) is 120,000.

Siloxane-modified polycarbonate (1) having a siloxane structure only in the main chain having the structural unit shown in Table 1 10 parts In this manner, an electrophotographic photosensitive member was prepared having a support, an intermediate layer, a charge generation layer, and a charge transport layer in this order, that is, the charge-transport layer is the surface layer.

A compound represented by the following structural Formula (8) 35 parts

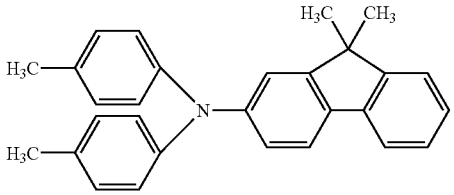

(8)

A compound represented by the following structural Formula (9) 5 parts

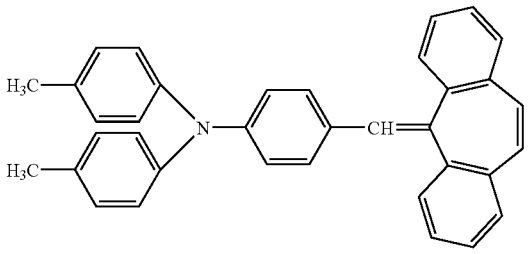

(9)

A copolymerization-type polyarylate resin represented by the following structural Formula (10) 50 parts

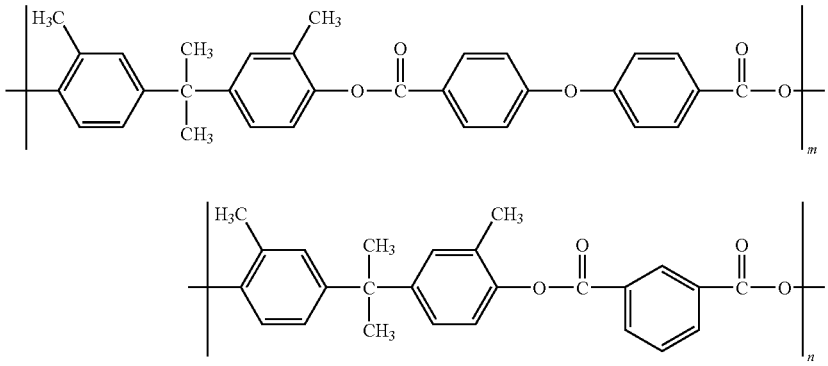

(10)

<Element Analysis by ESCA in the Outermost Surface and the Portion 0.2 μm Inward>

To evaluate the degree of distribution, of a fluorine-containing compound or a silicon-containing compound over the outermost surface of a surface layer, the ratio of a fluorine element or a silicon element present in the outermost surface was measured by ESCA (X-ray photoelectron spectroscopy). As described above, in consideration of the fact that the area that can be measured by ESCA is about 10,000 $\mu m^2$, the outermost surface and the portion 0.2 μm inward of an electrophotographic, photosensitive member were subjected to measurement without forming depressed portions according to the present invention on the photosensitive member.

In Table 2, the ratio of a fluorine element or a silicon element relative to the constituent elements present in the outermost surface of the surface layer of the electrophotographic photosensitive member is shown. In addition, the table shows ratio A/B where A (% by mass) represents the content of a fluorine element or a silicon element present in a portion 0.2 μm inward from the outermost surface of the photosensitive-member surface layer; and B (% by mass) represents the content of a fluorine element or a silicon element present in the outermost surface of the photosensitive member surface layer, the contents of the fluorine element or silicon element being measured by X-ray photoelectron spectroscopy (ESCA). The measurement conditions will be described below.

Apparatus used: Quantum 2000 Scanning ESCA Microprobe manufactured by PHI Inc. (Physical Electronics Industries, Inc.); Measurement conditions for the outermost surface and portion 0.2 μm inward (after etching):

X-ray source: Al Kal486.6 eV (25W15 kV), measurement area: 10,000 $\mu m^2$

Spectrum region: 1500×300 μm, Angle 45° Pass Energy 117.40 eV

Etching conditions:

Ion gun C60 (10 kV, 2 mm×2 mm), Angle 70°

A rate of 1.0 μm/100 min was required for etching the charge transport layer to a depth of 1.0 μm (after the charge transport layer was etched, the depth was identified by SEM observation of the section). Therefore, in the compositional analysis of a portion 0.2 μm inward from the outermost surface, element analysis of a portion 0.2 μm inward from the outermost surface can be performed by etching the charge transport layer for 20 minutes using an ion gun C60.

From the peak intensity of each element measured under the aforementioned conditions, surface atomic concentration (atom %) is calculated by use of a relative sensitive factor provided by PHI Inc.

The measurement peak-top ranges of individual elements constituting a surface layer are as follows:

C1s: 278 to 298 eV

F1s: 680 to 700 eV

Si2p: 90 to 110 eV

O1s: 525 to 545 eV

N1s: 390 to 410 eV

<Forming of the Depressed Portions on Electrophotographic Photosensitive Member>

Figure 11:
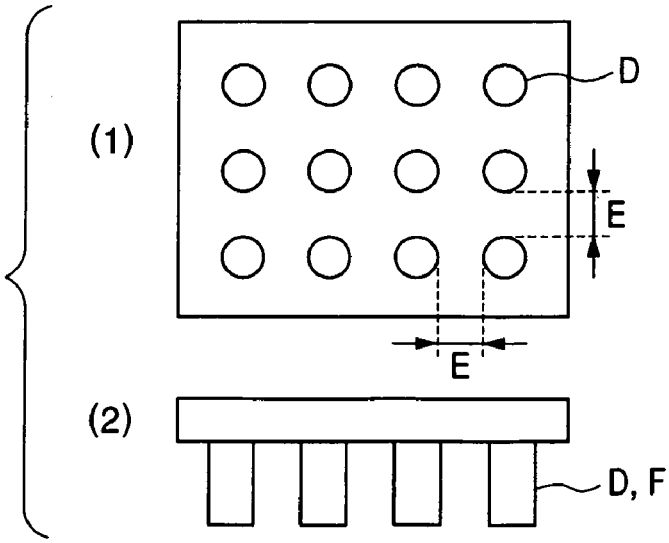
FIG. 11 is a view (partly enlarged view) illustrating the shape of a mold used in Example 1.

The electrophotographic photosensitive member manufactured by the aforementioned method was subjected to surface processing by a unit (shown in FIG. 7) equipped with a shape-transferring mold (shown in FIG. 11.) having a height (represented by F) of 1.4 μm, a major axis diameter of a cylinder (represented by D) of 2.0 μm and intervals (represented by E) between depressed portions, of 0.5 μm. During the processing, the temperature of the electrophotographic photosensitive member and the mold was controlled at 110° C. Shape transfer was carried out by applying a pressure of 50 $kg/cm^2$ while rotating the photosensitive member in the circumference direction. In FIG. 11, (1) is a view of the mold shape viewed from the top and (2) is a view of the mold shape viewed from the side.

<Measurement of Surface Shape of Electrophotographic Photosensitive Member>

The surface of the electrophotographic photosensitive member manufactured by: the aforementioned method was observed by a super-depth configuration determination microscope VK-9500 (manufactured by Keyence Corporation). The electrophotographic photosensitive member to be measured was placed on the table which was previously designed to fix a cylindrical support of the electrophotographic photosensitive member. The surface of the electrophotographic photosensitive member was observed at a distance of 130 mm apart from the top end of the photosensitive member. At that time, the 100 μm squares of the surface of the photosensitive member was observed by using an objective lens of 50×-magnification. The depressed portions observed in the field of view were analyzed by use of an analysis program.

The shape of the surface portion of each of the depressed portions in the field of view, the major axis diameter (Rpc) thereof and the depth (Rdv), which is the distance between the deepest part of a depressed portion and the opening surface thereof were measured. Then, the average of major axis diameters of the depressed portions was taken and made an average major axis diameters (Rpc-A) and the average of depths of the depressed portions was taken and made an average depth (Rdv-A). In addition, the ratio of the average depth (Rdv-A) to the average major axis diameter (Rpc-A), (Rdv-A)/(Rpc-A), was determined.

Figure 12:
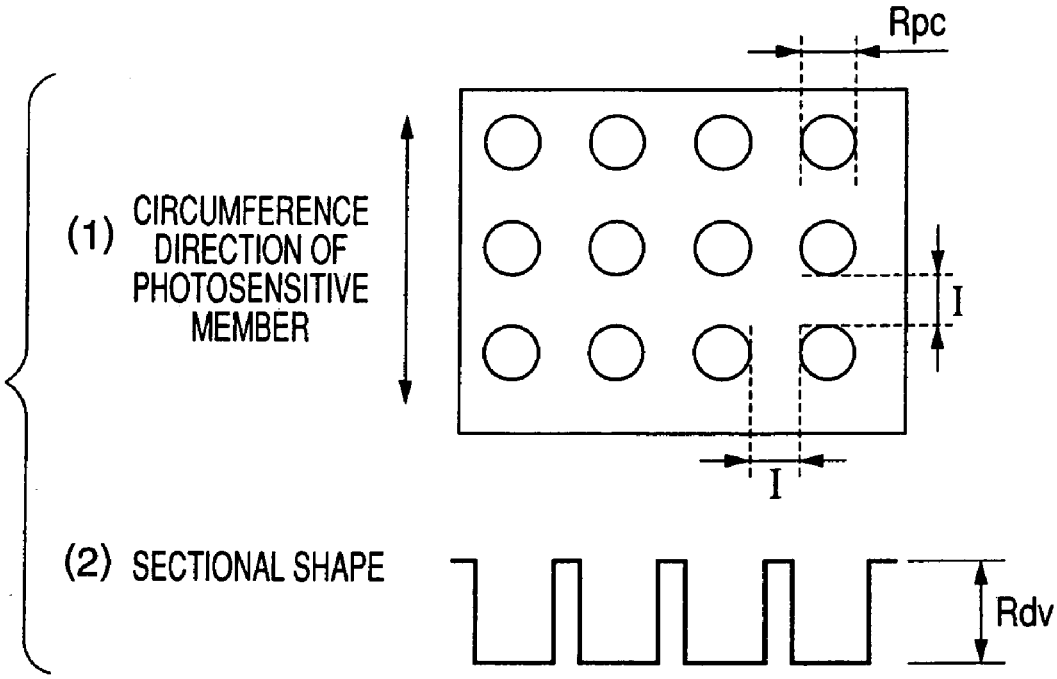
FIG. 12 is a view (partly enlarged view) illustrating an arrangement pattern of depressed portions in the outermost surface of the photosensitive member obtained in Example 1.

It was confirmed that the depressed portions in the shape of cylinder shown in FIG. 12 were formed on the surface of the electrophotographic photosensitive member. The interval I between the depressed portions was 0.5μ. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 1,600. Note that, in FIG. 12, (1) shows an arrangement state of the depressed portions formed on the surface of the photosensitive member as viewed in the circumference direction and (2) shows a sectional shape of the depressed portions.

The measurement values: Rpc-A, Rdv-A and Rdv-A/Rpc-A are shown in Table 2.

<Evaluation of Properties of Electrophotographic Photosensitive Member>

The electrophotographic photosensitive member manufactured by the aforementioned method was attached to an evaluation machine detailed below to carry out image formation. Output images were evaluated. Note that evaluation was performed in an environment of a high temperature and high humidity (23° C./50% RH)

As the electrophotographic apparatus to be used for evaluation, LBP (color laser jet 4600) manufactured by Hewlett-Packard was used. The contact pressure of the elastic cleaning blade applied to the photosensitive member was set at 550 mN/cm. Note that powdery material such as toner and silicone resin fine particles for imparting lubricity was not applied to the cleaning blade. Pre-exposure was turned off and the apparatus was modified such that the amount of laser light can be varied. The potential conditions were set such that the voltage (Vd) of a dark area of the electrophotographic photosensitive member was −500V and the voltage (Vl) of a light area thereof was −100 V. In this way, the initial voltage of the electrophotographic photosensitive member was controlled.

In the initial conditions, a paper-feed durability test using 10,000 A-4 size paper sheets was performed under two-sheet intermittent printing conditions. Note that the test chart used herein had a print percentage of 1%. During the duration test, there was performed no periodical supply of toner from the developing means to prevent an increase of the coefficient of friction between the cleaning blade and electrophotographic photosensitive member caused by a decrease in the amount of toner present in a nip between the cleaning blade and photosensitive member due to continuous printing of a low print percentage pattern.

Under these conditions, output of an image sample for image property evaluation, a kinetic coefficient of friction of a photosensitive member, blade chattering and blade turn-up were evaluated with respect to the initial stage of the duration test, 5,000 and 10,000 paper sheets.

Images for use in image property evaluation include a half-tone image, a solid black image and a solid white image, which were visually evaluated for defective images such as spots and black streaking, image density and fog. The evaluation results of the image properties are shown in Table 3.

The kinetic coefficient of friction is evaluated as an index of load applied to an electrophotographic photosensitive member and a cleaning blade. The numerical value thereof shows an increase or decrease of the amount of load applied to the electrophotographic photosensitive member having a surface processed and a cleaning blade. The smaller the kinetic coefficient of friction, the lower the load applied to an electrophotographic photosensitive member and a cleaning blade. The measurement was performed by the method below.

Measurement was performed by use of HEIDON-14 manufactured by Shinto Kagaku in normal temperature/normal humidity (25° C./50% RH). More specifically, a rubber blade was set in contact with an electrophotographic photosensitive member in such a state that a predetermined load was applied to the rubber blade. When the electrophotographic photosensitive member was moved horizontally at a scan speed of 50 mm/min, the friction force applied between the electrophotographic photosensitive member and the rubber blade was measured as a distortion amount of distortion gauge attached to the rubber blade and converted to a tensile load. The kinetic friction coefficient can be obtained from the value of [force (g) applied to a photosensitive member]/[load (g) applied to a blade] when the blade is in motion. The blade used was prepared by cutting a urethane blade (rubber hardness: 67°) manufactured by Hokushin Kogyou into pieces of 5 mm×30 mm×2 mm. Measurement of the kinetic friction coefficient was conducted under the conditions: a load of 50 g applied, in the forward direction, at an angle of 27°.

A series of evaluation results are shown in Table 3.

The blade chattering and turn-up, which reflect cleaning performance of a photosensitive member, were evaluated. The blade chattering refers to a phenomenon where the cleaning blade makes noise when an electrophotographic photosensitive member and a cleaning blade are rubbed with each other, or when an electrophotographic photosensitive member initiates or terminates rotation. As a major cause of blade chattering, large friction force generated between the electrophotographic photosensitive member and the cleaning blade may be mentioned. On the other hand, blade turn-up is a phenomenon where a cleaning blade made of rubber is reversely curled due to large friction force working between an electrophotographic photosensitive member and the cleaning blade when they are rubbed with each other. At that time, printing is stopped due to high torque or an abnormal image is formed due to insufficient cleaning caused by blade turn-up. The evaluation results are shown in Table 3. The column of "Initial" indicates blade chattering and blade turn-up occurred during initial image formation. The column of "5,000 sheet" indicates the blade chattering and blade turn-up occurred from the initial image formation time to 5,000-sheet printing time. The column of "10,000 sheet" indicates blade chattering and blade turn-up occurred from the 5,001-sheet printing time onward.

Evaluation on cleaning performance was performed based on the following evaluation indexes.

A: Neither blade chattering nor turn-up occurs

B: Extremely slight blade chattering occurs but no blade turn-up occurs

C: Slight blade chattering occurs but no blade turn-up occurs

D: Blade chattering occurs but no blade turn-up occurs

E: Blade turn-up occurs

Example 2

An electrophotographic photosensitive member was manufactured in the same manner as in Example 1 except that the siloxane-modified polycarbonate (2) having a structural unit shown in Table 1 was used in an addition amount of 5 parts in place of the silicon-containing compound to be added to the surface layer in manufacturing of the electrophotographic photosensitive member of Example 1.

The same processing was performed in the same manner as in Example 1 except that, in the mold used in Example 1, the height represented by F in FIG. 11 was changed to 2.9 μm. The surface shape of the photosensitive member was measured in the same manner as in Example 1, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 1600. The measurement values Rpc-A, Rdv-A and Rdv-A/Rpc-A and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 3

An electrophotographic photosensitive member was manufactured in the same manner as in Example 2, and it surface was processed in the same manner as in Example 1 except that, in the mold used in Example 1, the major axis diameter represented by D in FIG. 11 was changed to 4.5 μm, the interval represented by E was changed to 0.5 μm, the height represented by F was changed to 9.0 μm. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400. The measurement values Rpc-A, Rdv-A and Rdv-A/Rpc-A and ESCA data obtained from the surface of the photosensitive member having no depressed portions processed therein are shown in Table 2.

The evaluation of properties of the electrophotographic photosensitive member was performed in the same manner as in Example 1. The results are shown in Table 3.

Example 4

An electrophotographic photosensitive member was manufactured in the same manner as in Example 2, and its surface was processed in the same manner as in Example 1 except that, in the mold used in Example 1, the major axis diameter represented by D in FIG. 11 was changed to 1.5 μm, the interval represented by E was changed to 0.5 μm and the height represented by F was changed to 6.0 μm. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 2,500. The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 5

An electrophotographic photosensitive member was manufactured in the same manner as in Example 2, and its surface was processed in the same manner as in Example 1 except that, in the mold used in Example 1, the major axis diameter represented by D in FIG. 11 was changed to 0.4 μm, the interval represented by E was changed to 0.6 μm and the height represented by F was changed to 1.8 μm. The surface shape of the photosensitive member was measured in the same manner as in Example 1. As a result, it was confirmed that cylindrical depressed portions were formed on the surface of the photosensitive member. The results are shown in Table 1. The depressed portions were formed at intervals of 0.4 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 10,000. The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 6

A conductive layer, an intermediate layer and a charge generation layer were formed on a support in the same manner as in Example 2. A charge-transport layer coating solution was prepared in the same manner as in Example 2 except that a solvent mixture of chlorobenzene (350 parts) and dimethoxymethane (35 parts) were used in place of the solvent used in forming the charge transport layer. The charge-transport layer coating solution thus prepared was applied onto the charge generation layer by dip coating. In this manner, a charge transport layer was formed by coating as the surface layer of a laminate structure, which was formed by laminating the conductive layer, intermediate layer, charge generation layer and charge transport layer in this order on the support. Sixty (60) seconds after completion of the coating step, the support coated with the surface-layer coating solution was maintained for 120 seconds in a processing unit for a moisture condensation step, previously set at a relative humidity of 70% and an ambient temperature of 60° C. Sixty (60) seconds after completion of the moisture condensation step, the support was transferred to an air blow dryer previously heated to 120° C. within the unit. A drying step was performed for 60 minutes. In this manner, an electrophotographic photosensitive member having a charge transport layer, which has an average film thickness of 20 μm, as measured at a position of 130 mm from the top end of the support, and serving as the surface layer, was manufactured.

The surface shape of the photosensitive member was measured in the same manner as in Example 1. As a result, it was confirmed that depressed portions were formed on the surface of the photosensitive member. The depressed portions were formed at intervals of 1.8 μm. When the number of depressed portions, which satisfied a ratio (Rdv/Rpc), that is, a ratio of the depth to, the major axis diameter, of from more than 0.3 to 7.0 or less and were present in the unit area (100 μm×100 μm), was calculated, it was 278. The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3. Note that the electrophotographic photosensitive member to be subjected to ESCA measurement was formed in the above photosensitive member manufacturing step as follows. Immediately upon forming a surface layer by applying the charge-transport layer coating solution onto the substrate, the surface layer was subjected to the drying step in which the layer was dried for 60 minutes to obtain a photosensitive member having no depressed portions on the surface with an average film thickness of 20 μm.

Example 7

Figure 13:
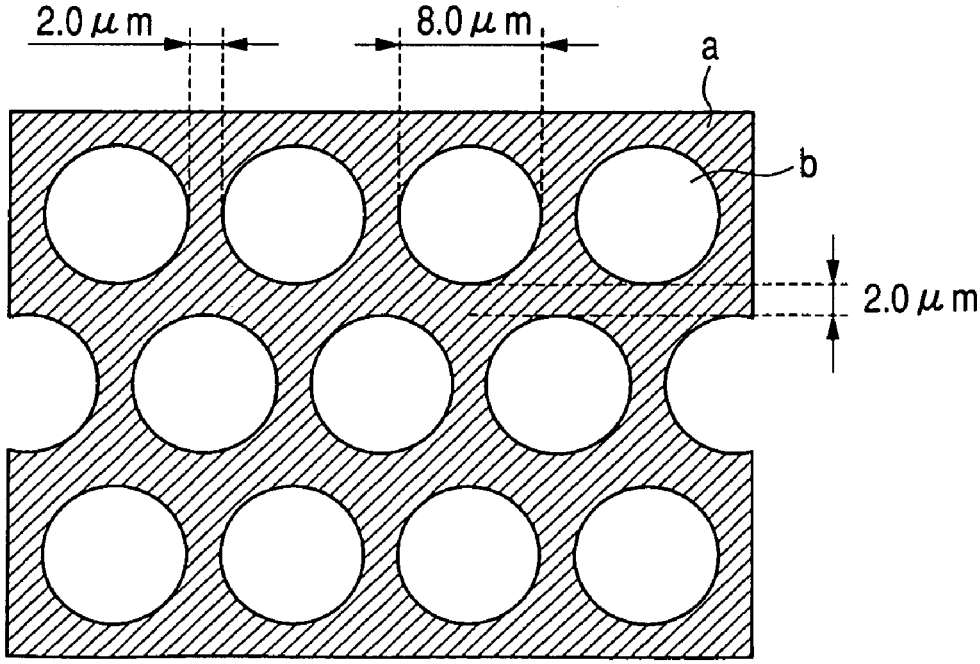
FIG. 13 is a view illustrating the arrangement pattern (partly enlarged) of a mask used in Example 7.

An electrophotographic photosensitive member was manufactured in the same manner as in Example 1. On the surface of the electrophotographic photosensitive member thus obtained, depressed portions were formed in accordance with a depressed portion forming method using a KrF excimer laser (wavelength λ=248 nm) as shown in FIG. 4. At that time, a mask of quartz glass was used which had a pattern, in which circular laser light transmissible portions b of 8.0 μm in diameter were arranged at intervals of 2.0 μm, as shown in Table 13 (note that reference numeral a of FIG. 13 indicates a laser shielding portion)

Irradiation energy was set at 0.9 J/cm$^3$. Further, irradiation was made in an area of 2 mm square per irradiation made once, and the surface was irradiated with the laser light three times per irradiation portion of 2 mm square. The depressed portions were likewise formed by a method in which, as shown in FIG. 4, the electrophotographic photosensitive member was rotated and the irradiation position was shifted in its axial direction, to form the depressed portions on the photosensitive member surface.

Figure 14:
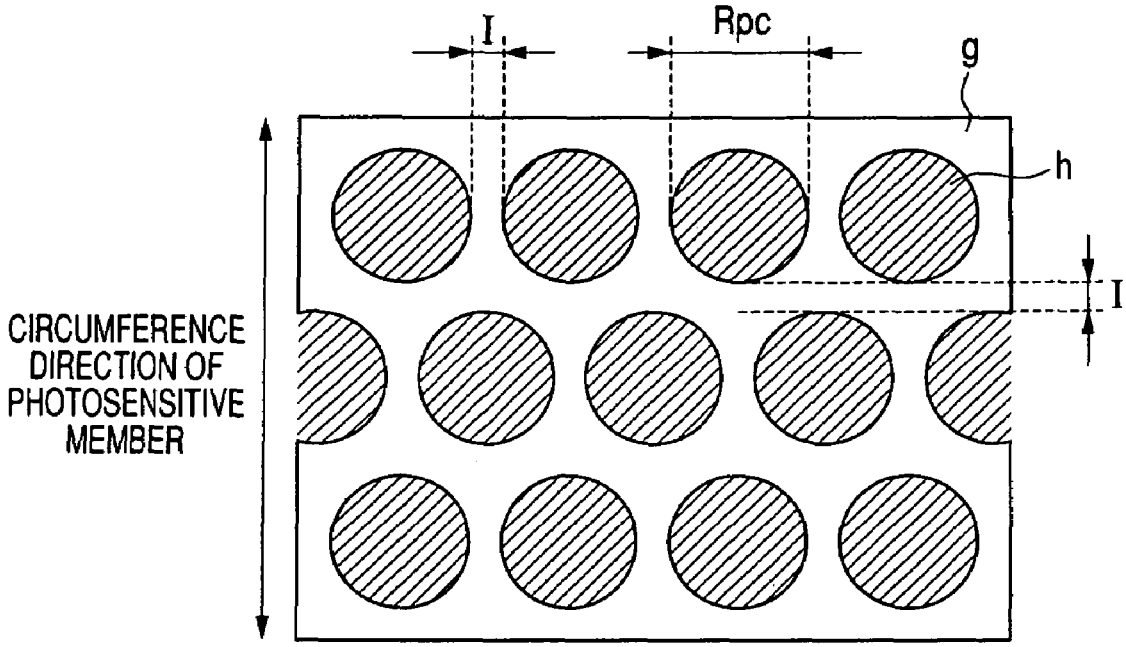
FIG. 14 is a view illustrating the arrangement pattern (partly enlarged) of a mask used in Example 7.

The surface shape of the photosensitive member was measured in the same manner as in Example 1. As a result, it was confirmed that depressed portions as shown in FIG. 14 were formed on the surface of the photosensitive member. The depressed portions were formed at intervals of 1.4 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 100. The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 8

An electrophotographic photosensitive member was manufactured in the same manner as in Example 1 except that the siloxane-modified polycarbonate (3) having a structural unit shown in Table 1 was used in an addition amount of 2 parts in place of the silicon-containing compound added to the surface layer in the manufacturing of the electrophotographic photosensitive member in Example 1.

The electrophotographic photosensitive member was processed in the same manner as in Example 1 except that the mold used in Example 3 was used. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400. The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 9

An electrophotographic photosensitive member was manufactured and processed in the same manner as in Example 8 except that the siloxane-modified polyester 1 having a structural unit shown in Table 1 was used in place of the silicon-containing compound added to the surface layer in the manufacturing of the electrophotographic photosensitive member in Example 1. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 10

An electrophotographic photosensitive member was manufactured in the same manner as in Example 1 except that the siloxane-modified polycarbonate (3) having a structural unit shown in Table 1 was used in an addition amount of 0.5 parts in place of the silicon-containing compound added to the surface layer in the manufacturing of the electrophotographic photosensitive member in Example 1.

The electrophotographic photosensitive member was processed in the same manner as in Example 1 except that the mold used in Example 3 was used. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data obtained from the surface of the photosensitive member having no depressed portions processed therein are shown in Table 2.

The evaluation of properties of the electrophotographic photosensitive member was performed in the same manner as in Example 1. The results are shown in Table 3.

Example 11

An electrophotographic photosensitive member was manufactured in the same manner as in Example 1 except that the siloxane-modified polycarbonate (3) having a structural unit shown in Table 1 was used in an addition amount of 4 parts in place of the silicon-containing compound to be added to the surface layer in the manufacturing of the electrophotographic photosensitive member in Example 1.

The electrophotographic photosensitive member was processed in the same manner as in Example 1 except that the mold used in Example 3 was used. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 12

An electrophotographic photosensitive member was manufactured in the same manner as in Example 1 except that a polyacrylate resin serving as a binder resin and represented by a structural Formula (10) was not used and the siloxane-modified polycarbonate (4) having a structural unit shown in Table 1 was used in an addition amount of 50 parts in place of the silicon-containing compound added to the surface layer in the manufacturing of the electrophotographic photosensitive member in Example The electrophotographic photosensitive member was processed in the same manner as in Example 1 except that the mold used in Example 3 was used. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 13

An electrophotographic photosensitive member was manufactured in the same manner as in Example 1 except that the siloxane-modified polycarbonate (4) having a structural unit shown in Table 1 was used in an addition amount of 4 parts in place of the silicon-containing compound added to the surface layer in the manufacturing of the electrophotographic photosensitive member in Example 1.

The electrophotographic photosensitive member was processed in the same manner as in Example 1 except that the mold used in Example 3 was used. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 14

An electrophotographic photosensitive member was manufactured in the same manner as in Example 1 except that the siloxane-modified polycarbonate (5) having a structural unit shown in Table 1 was used in an addition amount of 2 parts in place of the silicon-containing compound added to the surface layer in the manufacturing of the electrophotographic photosensitive member in Example 1.

The electrophotographic photosensitive member was processed in the same manner as in Example 1 except that the mold used in Example 3 was used. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of, depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 15

An electrophotographic photosensitive member was manufactured in the same manner as in Example 1 except that styrene-polydimethylsiloxane methacrylate (Aron GS-101CP, manufactured by Toagosei Co., Ltd.) was used in an addition amount of 2 parts in place of the silicon-containing compound added to the surface layer in the manufacturing of the electrophotographic photosensitive member in Example 1.

The electrophotographic photosensitive member was processed in the same manner as in Example 1 except that the mold used in Example 3 was used. The surface shape of the photosensitive member was measured in the same manner as in Example 1. As a result, it was confirmed that cylindrical depressed portions were formed on the surface of the photosensitive member. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 16

An electrophotographic photosensitive member was manufactured in the same manner as in Example 1 except that the siloxane-modified polycarbonate (3) having a structural unit shown in Table 1 was used in an addition amount of 1.8 parts in place of the silicon-containing compound added to the surface layer in the manufacturing of the electrophotographic photosensitive member in Example 1 and dimethylsilicone oil (KF-96-100 Cs, manufactured by Shin-Etsu Chemical) was added in an amount of 0.2 parts.

The electrophotographic photosensitive member was processed in the same manner as in Example 1 except that the mold used in Example 3 was used. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 17

An electrophotographic photosensitive member was manufactured in the same manner as in Example 1 except that dimethylsilicone oil (KF-96-100 cs, manufactured by Shin-Etsu Chemical) was added in an addition amount of 0.5 parts in place of the silicon-containing compound added to the surface layer in the manufacturing of the electrophotographic photosensitive member in Example 1.

The electrophotographic photosensitive member was processed in the same manner as in Example 1 except that the mold used in Example 3 was used. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 18

An electrophotographic photosensitive member was manufactured in the same manner as in Example 1 except that phenol-modified silicone oil (X-22-1821, manufactured by Shin-Etsu Chemical) was added in an addition amount of 0.5 parts in place of the silicon-containing compound added to the surface layer in the manufacturing of the electrophotographic photosensitive member in Example 1.

The electrophotographic photosensitive member was processed in the same manner as in Example 1 except that the mold used in Example 3 was used. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 19

An electrophotographic photosensitive member was manufactured in the same manner as in Example 1 except that the silicon-containing compound added to the surface layer was changed to 0.5 parts of dimethylsilicone oil (KF-96-100 cs, manufactured by Shin-Etsu Chemical) and 0.1 part of phenol-modified silicone oil (X-22-1821, manufactured by Shin-Etsu Chemical) in the manufacturing of the electrophotographic photosensitive member in Example 1.

The electrophotographic photosensitive member was processed in the same manner as in Example 1 except that the mold used in Example 3 was used. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 20

An electrophotographic photosensitive member was manufactured in the same manner as in Example 1 except that perfluoropolyether oil (perfluoropolyether oil, Demnum S-100, manufactured by Daikin Industries Ltd.) as a fluorine-containing compound was added in an addition amount of 2 parts in place of the silicon-containing compound added to the surface layer in the manufacturing of the electrophotographic photosensitive member in Example 1.

The electrophotographic photosensitive member was processed in the same manner as in Example 1 except that the mold used in Example 3 was used. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less, and were present in the unit area (100 μm×100 μm), was calculated, it was 400.

The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 21

An electrophotographic photosensitive member was manufactured in the same manner as in Example 1 except that the siloxane-modified polycarbonate (6) having a structural unit shown in Table 1 was used in an addition amount of 6 parts in place of the silicon-containing compound added to the surface layer in the manufacturing of the electrophotographic photosensitive member in Example 1. The surface of the photosensitive member was processed in the same manner as in Example 1 except that, in the mold used in Example 1, the major axis diameter represented by D in FIG. 11 was changed to 2.0 μm, the interval represented by E was changed to 0.5 μm, and the height represented by F was changed to 2.4 μm. The surface shape of the photosensitive member was measured in the same manner as in Example 1. As a result, it was confirmed that cylindrical depressed portions were formed on the surface of the photosensitive member. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 1,600.

The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3.

Example 22

A conductive layer, an intermediate layer and a charge generation layer were formed on a support in the same manner as in Example 2. Then, a charge-transport layer coating solution was prepared in the same manner as in Example 2, except that a solvent mixture of chlorobenzene (300 parts), oxosilane (150 parts) and dimethoxymethane (50 parts) were used in place of the solvent to be used in forming a charge transport layer. The charge-transport layer coating solution thus prepared was applied onto the charge generation layer by dip coating. In this manner, a charge transport layer was formed by coating as the surface layer of a laminate structure, which was formed by laminating the conductive layer, the intermediate layer, the charge generation layer and the charge transport layer in this order on the support. Sixty (60) seconds after completion of the coating step, the support coated with the surface-layer coating solution was maintained for 120 seconds in a processing unit for the moisture condensation step, previously set at a relative humidity of 80% and an ambient temperature of 50° C. within the unit. Sixty (60) seconds after completion of the moisture condensation step, the support was transferred to an air blow dryer previously heated to 120° C. within the unit. A drying step was performed for 60 minutes. In this manner, an electrophotographic photosensitive member having a charge transport layer, which has an average film-thickness of 20 μm, as measured at a position of 130 mm from the top end of the support, and serving as the surface layer, was manufactured.

The surface shape of the photosensitive member was measured in the same manner as in Example 1. As a result, it was confirmed that depressed portions were formed on the surface of the photosensitive member. FIG. 15 shows an image observed under a laser microscope, of depressed portions on the surface of the electrophotographic photosensitive member prepared in this example. The depressed portions were formed at intervals of 0.2 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400. The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3. Note that the electrophotographic photosensitive member to be subjected to ESCA measurement was formed in the above photosensitive member manufacturing step as follows. Immediately upon forming a surface layer by applying the charge-transport layer coating solution onto the substrate, the surface layer was subjected to the drying step without performing the moisture condensation step. In the drying step, the layer was dried for 60 minutes to obtain a photosensitive member having no depressed portions processed on the surface of the charge transport layer having an average film thickness of 20 μm.

Example 23

A conductive layer, an intermediate layer and a charge generation layer were formed on a support in the same manner as in Example 1. Then, a charge-transport layer coating solution was prepared in the same manner as in Example 1, except that a solvent mixture of chlorobenzene (300 parts), dimethoxymethane (140 parts) and (methylsulfinyl)methane (10 parts) were used in place of the solvent used in forming a charge transport layer. The charge-transport layer coating solution thus prepared was applied onto the charge generation layer by dip coating. In this manner, a charge transport layer was formed as the surface layer of a laminate structure, which was formed by laminating the conductive layer, the intermediate layer, the charge generation layer and the charge transport layer in this order on the support. Sixty (60) seconds after completion of the coating step, the support coated with the surface-layer coating solution was maintained for 180 seconds in a processing unit for a moisture condensation step, previously set at a relative humidity of 70% and an ambient temperature of 45° C. within the unit. Sixty (60) seconds after completion of the moisture condensation step, the support was transferred to an air blow dryer previously heated to 120° C. within the dryer. A drying step was performed for 60 minutes. In this manner, an electrophotographic photosensitive member having a charge transport layer, which has an average film thickness of 20 μm, as measured at a position of 130 mm from the top end of the support, and serving as the surface layer, was manufactured.

The surface shape of the photosensitive member was measured in the same manner as in Example 1. As a result, it was confirmed that depressed portions were formed on the surface of the photosensitive member. FIG. 15 shows an image observed under a laser microscope, of depressed portions on the surface of the electrophotographic photosensitive member prepared in this example. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 2,500. The measurement values Rpc-A, Rdv-A and Rdv-A/Rpc-A, and ESCA data obtained from the surface of the photosensitive member having no depressed portions processed therein are shown in Table 2. The evaluation of properties of the electrophotographic photosensitive member was performed in the same manner as in Example 1. The results are shown in Table 3. Note that the electrophotographic photosensitive member to be subjected to ESCA measurement was formed in the above photosensitive member manufacturing step as follows. Immediately upon forming a surface layer by applying the charge-transport layer coating solution onto the substrate, the surface layer was subjected to the drying step without performing the moisture condensation step. In the drying step, the layer was dried for 60 minutes to obtain a photosensitive member having no depressed portions on the surface of the charge transport layer with an average film thickness of 20 μm.

Comparative Example 1

An electrophotographic photosensitive member was manufactured in the same manner as in Example 1. The surface shape of the photosensitive member was measured in the same manner as in Example 1 except that the surface of the photosensitive member was not processed by the mold used in Example 1. Since the surface shape was not processed, almost flat surface layer of 20 μm in film thickness was obtained having no distinguishable projections and depressions.

The measurement values Rpc-A, Rdv-A and Rdv-A/Rpc-A and ESCA data are shown in Table 2. The evaluation of properties of the electrophotographic photosensitive member was performed in the same manner as in Example 1. The results are shown in Table 3.

Comparative Example 2

An electrophotographic photosensitive member was manufactured in the same manner as in Example 1. The surface of the photosensitive member was processed in the same manner as in Example 1 except that, in the mold used in Example 1, major axis diameter represented by D in FIG. 11 was changed to 4.2 μm, the interval represented by E was changed to 0.8 μm and the height represented by F was changed to 2.0 μm. The surface shape of the photosensitive member was checked in the same manner as in Example 1. As a result, cylindrical depressed portions were formed. The depressed portions are formed at intervals of 0.8 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data obtained from the photosensitive member having not been processed on the surface are shown in Table 2. The evaluation of properties of the electrophotographic photosensitive member was performed in the same manner as in Example 1. The results are shown in Table 3.

Comparative Example 3

An electrophotographic photosensitive member was manufactured in the same manner as in Example 1 except that the siloxane-modified polycarbonate (2) having a structural unit shown in Table 1 was used in an addition amount of 5 parts in place of the silicon-containing compound added to the surface layer in the manufacturing of the electrophotographic photosensitive member in Example 1. The surface of the photosensitive member was processed in the same manner as in Example 1 except that, in the mold used in Example 1, the major axis diameter represented by D in FIG. 11 was changed to 4.2 μm, the interval represented by E was changed to 0.8 μm and the height represented by F was changed to 2.0 μm. The surface shape of the photosensitive member was measured in the same manner as in Example 1. As a result, it was confirmed that cylindrical depressed portions were formed and the depressed portions were formed at intervals of 0.8 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 400.

The measurement values Rpc-A, Rdv-A and Rdv-A/Rpc-A, and ESCA data measured from the surface of the photosensitive member having not been processed on the surface are shown in Table 2. The evaluation of properties of the electrophotographic photosensitive member was performed in the same manner as in Example 1. The results are shown in Table 3.

Comparative Example 4

An electrophotographic photosensitive member was manufactured in the same manner as in Example 1 except that the silicon-containing compound was not added to the surface layer in the manufacturing of the electrophotographic photosensitive member in Example 1. The surface of the photosensitive member was processed in the same manner as in Example 1 except that, in the mold used in Example 1, the major axis diameter represented by D in FIG. 11 was changed to 2.0 μm, the interval represented by E was changed to 0.5 μm and the height represented by F was changed to 2.4 μm. The surface shape of the photosensitive member was measured in the same manner as in Example 1. As a result, it was confirmed that cylindrical depressed portions were formed. The depressed portions were formed at intervals of 0.5 μm. When the number of depressed portions, which satisfied a ratio (Rdv/Rpc), that is, a ratio of the depth to the major axis diameter, of from more than 0.3 to 7.0 or less and were present in the unit area (100 μm×100 μm), was calculated, it was 1,600.

The measurement values Rpc-A, Rdv-A and Rdv-A/Rpc-A, and ESCA data measured from the photosensitive member having not been processed on the surface are shown in Table 2. The evaluation of properties of the electrophotographic photosensitive member was performed in the same manner as in Example 1. The results are shown in Table 3.

TABLE 1

| | Structure of Silicon-containing compound | | | | | | | |
|---|---|---|---|---|---|---|---|---|
| | Siloxane compound 1 | | Siloxane compound 2 | | | Viscosity-average molecular weight | Addition amount of silicon-containing Compound (mass ratio based | The content (parts by mass) of siloxane in compound (mass ratio of |
| | No. | m | No. | n | bisphenol | (Mv) | on solid matter) | material charged) |
| Siloxane-modified polycarbonate (1) | (4-1) | 10 | — | — | (2-13) | 42000 | 10.0% | 10% |

TABLE 1-continued

| | Structure of Silicon-containing compound | | | | | | | |
|---|---|---|---|---|---|---|---|---|
| | Siloxane compound 1 | | Siloxane compound 2 | | | Viscosity-average molecular weight | Addition amount of silicon-containing Compound (mass ratio based | The content (parts by mass) of siloxane in compound (mass ratio of |
| | No. | m | No. | n | bisphenol | (Mv) | on solid matter) | material charged) |
| Siloxane-modified polycarbonate (2) | (4-1) | 40 | — | — | (2-13) | 28000 | 5.3% | 20% |
| Siloxane-modified polycarbonate (3) | (4-1) | 40 | (5-1) | 40 | (2-13) | 20600 | 2.2% | 40% |
| Siloxane-modified polycarbonate (4) | (4-1) | 20 | (5-1) | 20 | (2-13) | 26000 | 4.3% | 20% |
| Siloxane-modified polycarbonate (5) | (4-1) | 60 | (5-1) | 60 | (2-13) | 15000 | 0.6% | 60% |
| Siloxane-modified polycarbonate (6) | (4-1) | 60 | (5-1) | 70 | (2-13) | 16100 | 6.3% | 65% |
| Siloxane-modified polyester (1) | (4-1) | 40 | (5-1) | 40 | (2-2) | 22000 | 2.2% | 40% |

TABLE 2

| | Measurement data of Examples | | | | | |
|---|---|---|---|---|---|---|
| | | | | | ESCA measurement | |
| | Rpc-A | Rdv-A | Rdv-A/ Rpc-A | Addition amount of fluorine- or silicon-containing compound (mass ratio based on solid matter) | Ratio of fluorine or silicon element in constitution elements of the outermost surface | Ratio A/B |
| Example 1 | 2.0 | 0.8 | 0.4 | 10.0% | 2.2% | 0.6 |
| Example 2 | 2.0 | 1.8 | 0.9 | 5.3% | 4.1% | 0.4 |
| Example 3 | 4.5 | 5.0 | 1.1 | 5.3% | 4.1% | 0.4 |
| Example 4 | 1.5 | 3.1 | 2.1 | 5.3% | 4.1% | 0.4 |
| Example 5 | 0.4 | 0.8 | 2.0 | 5.3% | 4.1% | 0.4 |
| Example 6 | 4.2 | 6.0 | 1.4 | 5.3% | 4.1% | 0.4 |
| Example 7 | 2.9 | 3.2 | 1.1 | 5.3% | 4.1% | 0.4 |
| Example 8 | 4.5 | 5.0 | 1.1 | 2.2% | 14.2% | 0.03 |
| Example 9 | 4.5 | 5.0 | 1.1 | 2.2% | 13.5% | 0.03 |
| Example 10 | 4.5 | 5.0 | 1.1 | 0.6% | 8.1% | 0.02 |
| Example 11 | 4.5 | 5.0 | 1.1 | 4.3% | 15.4% | 0.05 |
| Example 12 | 4.5 | 5.0 | 1.1 | 55.6% | 17.1% | 0.30 |
| Example 13 | 4.5 | 5.0 | 1.1 | 4.3% | 10.4% | 0.1 |
| Example 14 | 4.5 | 5.0 | 1.1 | 2.2% | 15.3% | 0.03 |
| Example 15 | 4.5 | 5.0 | 1.1 | 2.2% | 7.1% | 0.1 |
| Example 16 | 4.5 | 5.0 | 1.1 | 2.2% | 15.4% | 0.03 |
| Example 17 | 4.5 | 5.0 | 1.1 | 0.6% | 5.8% | 0.1 |
| Example 18 | 4.5 | 5.0 | 1.1 | 0.6% | 5.4% | 0.2 |
| Example 19 | 4.5 | 5.0 | 1.1 | 0.7% | 5.5% | 0.1 |
| Example 20 | 4.5 | 5.0 | 1.1 | 2.2% | 4.3% | 0.3 |
| Example 21 | 2.0 | 1.2 | 0.6 | 6.3% | 15.8% | 0.03 |
| Example 22 | 4.8 | 8.5 | 1.8 | 5.3% | 4.1% | 0.4 |
| Example 23 | 2.0 | 6.5 | 3.3 | 5.3% | 4.1% | 0.4 |
| Comparative Example 1 | 0.014 | 0.010 | 0.7 | 10.0% | 2.2% | 0.6 |
| Comparative Example 2 | 4.2 | 0.8 | 0.2 | 10.0% | 2.2% | 0.6 |
| Comparative Example 3 | 4.2 | 0.8 | 0.2 | 5.3% | 4.1% | 0.4 |
| Comparative Example 4 | 2.0 | 1.2 | 0.6 | 0.0% | 0.0% | — |

TABLE 3

| | Duration test results | | | | | | | | |
|---|---|---|---|---|---|---|---|---|---|
| | Blade chattering/ turn-up | | | Kinetic friction coefficient | | | Image property | | |
| | Initial | 5000 sheet | 10000 sheet | Initial | After 5000-sheet printing | After 10000-sheet printing | Initial | After 5000-sheet printing | After 10000-sheet printing |
| Example 1 | A | B | C | 0.21 | 0.47 | 0.64 | Good | Slightly vertical streak | Slightly vertical streak |
| Example 2 | A | B | B | 0.17 | 0.31 | 0.49 | Good | Good | Good |
| Example 3 | A | A | B | 0.09 | 0.25 | 0.44 | Good | Good | Good |
| Example 4 | A | A | A | 0.07 | 0.17 | 0.28 | Good | Good | Good |
| Example 5 | A | A | B | 0.08 | 0.22 | 0.41 | Good | Good | Good |
| Example 6 | A | A | B | 0.08 | 0.21 | 0.33 | Good | Good | Good |
| Example 7 | A | A | B | 0.11 | 0.23 | 0.39 | Good | Good | Good |
| Example 8 | A | A | A | 0.04 | 0.18 | 0.21 | Good | Good | Good |
| Example 9 | A | A | A | 0.05 | 0.19 | 0.22 | Good | Good | Good |
| Example 10 | A | A | B | 0.12 | 0.27 | 0.34 | Good | Good | Good |
| Example 11 | A | A | A | 0.04 | 0.15 | 0.31 | Good | Good | Slightly low density |
| Example 12 | A | B | C | 0.05 | 0.18 | 0.51 | Good | Good | Slightly vertical streak |
| Example 13 | A | A | B | 0.07 | 0.21 | 0.38 | Good | Good | Slightly vertical streak |
| Example 14 | A | A | A | 0.03 | 0.14 | 0.22 | Good | Good | Slightly low density |
| Example 15 | A | A | B | 0.12 | 0.31 | 0.48 | Good | Good | Slightly vertical streak |
| Example 16 | A | A | A | 0.03 | 0.15 | 0.20 | Good | Good | Good |
| Example 17 | A | B | B | 0.16 | 0.25 | 0.38 | Good | Good | Slightly low density |
| Example 18 | A | B | B | 0.15 | 0.26 | 0.41 | Good | Good | Slightly low density |
| Example 19 | A | B | B | 0.18 | 0.24 | 0.44 | Good | Good | Slightly low density |
| Example 20 | A | B | B | 0.25 | 0.34 | 0.49 | Good | Good | Slightly vertical streak |
| Example 21 | A | A | B | 0.07 | 0.22 | 0.41 | Slightly low density | Slightly low density | Low density, fogging |
| Example 22 | A | A | B | 0.11 | 0.24 | 0.44 | Good | Good | Good |
| Example 23 | A | A | B | 0.12 | 0.18 | 0.38 | Good | Good | Good |
| Comparative Example 1 | B | E | E | 0.51 | 1.12 | 1.34 | Good | vertical streak | vertical streak |
| Comparative Example 2 | A | C | E | 0.33 | 0.54 | 1.09 | Good | Slightly vertical streak | vertical streak |
| Comparative Example 3 | A | C | E | 0.29 | 0.57 | 1.21 | Good | Slightly vertical streak | vertical streak |
| Comparative Example 4 | C | E | E | 0.54 | 0.81 | 1.21 | Slightly vertical streak | vertical streak | vertical streak |

The aforementioned results, specifically, comparison of Examples 1 to 23 and Comparative Examples 1 to 4 demonstrates that the cleaning performance of the electrophotographic photosensitive member, in particular, chattering and turn-up of cleaning blade during long-term repeated use, can be improved by incorporating a silicon-containing compound or a fluorine-containing compound into the surface layer of the electrophotographic photosensitive member and forming depressed portions, which satisfy a ratio (Rdv/Rpc) of the depth to the major axis diameter, of from more than 0.3 to 7.0 or less, on the surface of the electrophotographic photosensitive member. The results of kinetic friction coefficients of electrophotographic photosensitive members having depressed portions according to the present invention show that, in the electrophotographic photosensitive member having depressed portions of the present invention, the friction resistance between the photosensitive member and a cleaning blade is reduced even after the photosensitive member is repeatedly used in continuous copying for a long time. In the evaluation of the present invention, the 10,000 paper-sheets durability test was performed on the photosensitive members having a photosensitive layer formed on the support of 30 mm in diameter. Even under the evaluation conditions, the effect of reducing blade chattering was confirmed. In the beginning of using a photosensitive member, chattering of a blade is unlikely to occur as long as depressed portions are formed on the surface of the photosensitive member. However, when the photosensitive member is repeatedly used, the persistence of the effect varies depending upon the shape of the depressed portions on the surface of the photosensitive member. Therefore, it is considered that the effect of reducing the amount of load between a photosensitive member and a cleaning blade lasts by virtue of specific depressed portions formed on the surface of a photosensitive member, thereby improving blade chattering.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-085141, filed Mar. 28, 2007, which is hereby incorporated by reference in its entirety.

What is claimed is:

1. An electrophotographic photosensitive member comprising a support and a photosensitive layer formed on the support and containing a silicon-containing compound or a fluorine-containing compound in a surface layer in an amount of 0.6% by mass or more relative to a total solid matter of the surface layer, wherein:

the electrophotographic photosensitive member has depressed portions which are independent from one another, in a number of from 50 or more to 70,000 or less per unit area (100 μm×100 μm), over the entire region of a surface, and, the depressed portions each have a ratio of a depth (Rdv) that shows a distance between the deepest part of each depressed portion and the opening surface thereof to a major axis diameter (Rpc) of each depressed portion, Rdv/Rpc, of from more than 0.3 to 7.0 or less, and a depth (Rdv) of from 0.1 μm or more to 10.0 μm or less; and the total present ratio of a fluorine element and a silicon element relative to constitutional elements in an outermost surface of the surface layer of the electrophotographic photosensitive member obtained by x-ray photoelectron spectroscopy (ESCA) is 1.0% by mass or more; and a ratio (A/B) is larger than 0.0 and smaller than 0.5, where A (% by mass) is defined as a total content of a fluorine element and a silicon element present at a portion 0.2 μm inward from the outermost surface of the surface layer of the electrophotographic photosensitive member and B (% by mass) is defined as a total content of a fluorine element and a silicon element present in the outermost surface, with the contents of the fluorine element and silicon element obtained with x-ray photoelectron spectroscopy (ESCA).

2. The electrophotographic photosensitive member according to claim 1, wherein the depth (Rdv) is from 0.5 μm or more to 10.0 μm or less and the ratio of the depth (Rdv) to the major axis diameter (Rpc), Rdv/Rpc, is from more than 1.0 to 7.0 or less.

3. The electrophotographic photosensitive member according to claim 1, wherein the silicon-containing compound is a polysiloxane having at least a structural repeat unit represented by Formula (1):

(1)

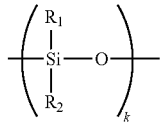

in the Formula (1), $R_1$ and $R_2$ may be the same or different and represent a hydrogen atom, a halogen atom, an alkoxy group, a nitro group, a substituted or unsubstituted alkyl group, or a substituted or unsubstituted aryl group; and k represents a positive integer from 1 to 500.

4. The electrophotographic photosensitive member according to claim 1, wherein the silicon-containing compound is a polycarbonate or polyester having a structural repeat unit represented by Formula (4) below and a structural repeat unit represented by Formula (2) or (3) below:

(2)

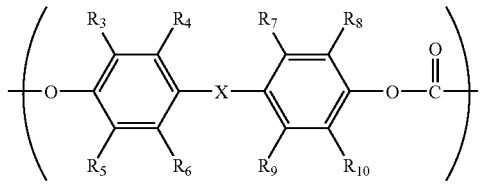

(3)

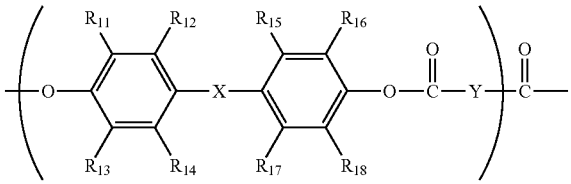

in Formulas (2) and (3), X and Y represent a single bond, —O—, —S—, substituted or unsubstituted alkylidene group; $R_3$ to $R_{18}$ may be the same or different and represent a hydrogen atom, a halogen atom, an alkoxy group, a nitro group, a substituted or unsubstituted alkyl group, a substituted or unsubstituted aryl group:

(4)

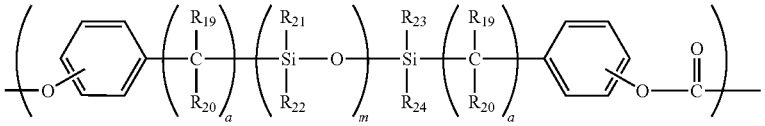

in Formula (4), $R_{19}$ and $R_{20}$ may the same or different and represent a hydrogen atom, an alkyl group or an aryl group; $R_{21}$ to $R_{24}$ may be the same or different and represent a hydrogen atom, a halogen atom, a substituted or unsubstituted alkyl group, a substituted or unsubstituted aryl group; a represents an integer from 1 to 30; and m represents an integer from 1 to 500.

5. The electrophotographic photosensitive member according to claim 4, wherein the silicon-containing compounds comprises at least two said polycarbonates, two said polyesters, or a mixture of the polycarbonate and the polyester.

6. The electrophotographic photosensitive member according to claim 4, wherein, in the polycarbonate or polyester, a ratio of siloxane moieties relative to total structural repeat units is 10.0% by mass or more and 60.0% by mass or less.

7. The electrophotographic photosensitive member according to claim 4, wherein the silicon-containing compound is a polycarbonate or polyester having a structure represented by Formula (5) below at one of the ends or both ends:

(5)

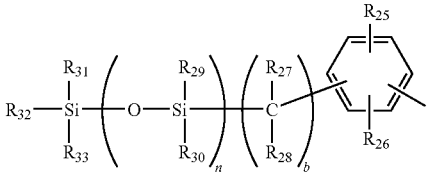

in Formula (5), $R_{25}$ and $R_{26}$ may the same or different and represent a hydrogen atom, a halogen atom, an alkoxy group, a nitro group, a substituted or unsubstituted alkyl group, a substituted or unsubstituted aryl group; $R_{27}$ and $R_{28}$ may be the same or different and represent a hydrogen atom, alkyl group or an aryl group; $R_{29}$ to $R_{33}$ may be the same or different and represent a hydrogen atom, a halogen atom, a substituted or unsubstituted alkyl group, or a substituted or unsubstituted aryl group; b represents an integer from 1 to 30; and n represents an integer from 1 to 500.

8. The electrophotographic photosensitive member according to claim 1, wherein the silicon-containing compound is silicone oil or modified silicone oil represented by Formula (6) below:

(6)

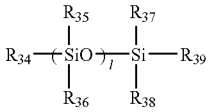

in Formula (6), $R_{34}$ to $R_{39}$ may be the same or different and represent a hydrogen atom, a halogen atom, a substituted or unsubstituted alkyl group, or a substituted or unsubstituted aryl group; and l represents an average value of structural repeat unit number.

9. The electrophotographic photosensitive member according to claim 1, wherein the silicon-containing compound is any one of acrylate, methacrylate and styrene, having a siloxane structure at a side chain.

10. The electrophotographic photosensitive member according to claim 1, wherein the depth (Rdv) is from more than 3.0 μm to 10.0 μm or less.

11. The electrophotographic photosensitive member according to claim 1, wherein the ratio (Rdv/Rpc), which is a ratio of the depth (Rdv) to the major axis diameter (Rpc), is from more than 1.5 to 7.0 or less.

12. The electrophotographic photosensitive member according to claim 1, wherein an average major axis diameter (Rpc-A) of the depressed portions is from 0.4 μm or more to 4.8 μm or less and an average depth (Rdv-A) of the depressed portions is from 0.8 μm or more to 8.5 μm or less.

13. The electrophotographic photosensitive member according to claim 1, wherein the surface layer contains the silicon-containing compound or the fluorine-containing compound in an amount of 0.6% by mass or more to 10.0% by mass or less relative to total solid matter of the surface layer.

14. The electrophotographic photosensitive member according to claim 1, wherein the surface layer contains a binder resin and a lubricant and the lubricant is the silicon-containing compound or the fluorine-containing compound.

15. A process cartridge comprising at least the electrophotographic photosensitive member according to claim 1 and a cleaning means integrally supported, wherein the process cartridge is detachably attached to an electrophotographic apparatus main body, and the cleaning means has a cleaning blade.

16. An electrophotographic apparatus comprising the electrophotographic photosensitive member according to claim 1, a charging means, an exposure means, a developing means, a transfer means and a cleaning means, wherein the cleaning means has a cleaning blade.

17. An electrophotographic photosensitive member comprising a support and a photosensitive layer formed on the support and containing a silicon-containing compound or a fluorine-containing compound in a surface layer in an amount of 0.6% by mass or more relative to a total solid matter of the surface layer, the electrophotographic photosensitive member being used in contact with a cleaning blade on the surface thereof, wherein:

the electrophotographic photosensitive member has depressed portions which are independent from one another, in a number of from 50 or more to 70,000 or less per unit area (100 μm×100 μm), at least over the entire region of a surface portion of the electrophotographic photosensitive member which is in contact with the cleaning blade, and, the depressed portions each have a ratio of a depth (Rdv) that shows a distance between the deepest part of each depressed portion and the opening surface thereof to a major axis diameter (Rpc) of each depressed portion, Rdv/Rpc, of from more than 0.3 to 7.0 or less, and a depth (Rdv) of from 0.1 μm or more to 10.0 μm or less; and the total present ratio of a fluorine element and a silicon element relative to constitutional elements in an outermost surface of the surface layer of the electrophotographic photosensitive member obtained by x-ray photoelectron spectroscopy (ESCA) is 1.0% by mass or more; and a ratio (A/B) is larger than 0.0 and smaller than 0.5, where A (% by mass) is defined as a total content of a fluorine element and a silicon element present at a portion 0.2 μm inward from the outermost surface of the surface layer of the electrophotographic photosensitive member and B (% by mass) is defined as a total content of a fluorine element and a silicon element present in the outermost surface, with the contents of the fluorine element and silicon element obtained with x-ray photoelectron spectroscopy (ESCA).

18. A process cartridge comprising at least the electrophotographic photosensitive member according to claim 17 and a cleaning means integrally supported, wherein the process cartridge is detachably attached to an electrophotographic apparatus main body, and the cleaning means has a cleaning blade.

19. An electrophotographic apparatus comprising the electrophotographic photosensitive member according to claim 17, a charging means, an exposure means, a developing means, a transfer means and a cleaning means, wherein the cleaning means has a cleaning blade.

* * * * *